US006262665B1

(12) United States Patent
Eskander

(10) Patent No.: US 6,262,665 B1
(45) Date of Patent: Jul. 17, 2001

(54) FOUR—STATES WARNING SWITCH

(75) Inventor: Nader Nessem Eskander, 3, Amrou Ebn El Asse St. Apt. 24, Roushdy, Alexandria (EG)

(73) Assignee: Nader Nessem Eskander (EG)

( * ) Notice: Subject to any disclaimer, the term of this patent is extended or adjusted under 35 U.S.C. 154(b) by 0 days.

(21) Appl. No.: 09/272,352

(22) Filed: Mar. 19, 1999

Related U.S. Application Data

(60) Provisional application No. 60/084,345, filed on May 5, 1998.

(51) Int. Cl.[7] ..... G08B 23/00
(52) U.S. Cl. ..... 340/573.1; 340/574; 340/693.5
(58) Field of Search ..... 340/573.1, 574, 340/693.5, 541, 545.1, 546

(56) References Cited

U.S. PATENT DOCUMENTS

| | | | | |
|---|---|---|---|---|
| 4,667,188 | * | 5/1987 | Schwartz | 340/689 |
| 5,365,217 | * | 11/1994 | Toner | 340/539 |
| 5,455,566 | * | 10/1995 | Conway | 340/693 |
| 5,541,579 | * | 7/1996 | Kiernan | 340/573 |
| 5,589,818 | * | 12/1996 | Queen | 340/506 |
| 5,629,679 | * | 5/1997 | Cranford et al. | 340/574 |
| 5,635,908 | * | 6/1997 | Soper | 340/574 |
| 5,774,051 | * | 6/1998 | Kostusiak | 340/539 |

* cited by examiner

*Primary Examiner*—Daniel J. Wu
*Assistant Examiner*—Sihong Huang

(57) ABSTRACT

The four-states warning switch is a special warning device of exceptional features. One of these features, allows the user to send an initial signal, in case he only suspects that he may be attacked, assaulted, go into a coma or may face a danger of any other type. He does so by pressing the device's handle, closing a "suspicion circuit" that transmits a "suspicion signal" to a security office, a police station, an ambulance or a doctor's clinic. The user then shifts the handle rightwards while it is still pressed, bringing it to a position, where the device is ready to automatically close a warning circuit in case he releases the handle. This is the second important feature of the device, for if the user releases his/her hand involuntarily in case of an attack or in case he becomes unconscious, a warning signal is automatically transmitted. On the other hand, the user can bring the device back to its "idle state" manually from the "suspicion state", whenever he feels safe. However, besides these two exceptional features, the device also keeps its prime feature as a direct warning facility. The user can simply bring the device to its "direct warning state" by shifting the handle leftwards without pressing it. He/she benefits from this feature of the device in case of a sudden attack or on facing an unexpected danger.

17 Claims, 27 Drawing Sheets

FOUR— STATES WARNING SWITCH

This application claims the benefit of U.S. Provisional Application No. 60/084,345 filed on May 5, 1998.

CROSS-REFERENCE TO RELATED APPLICATIONS

Not applicable

STATEMENT REGARDING FEDERALLY SPONSORED RESEARCH OF DEVELOPMENT

Not applicable

REFERENCE TO A MICROFICHE APPENDIX

Not applicable

BACKGROUND OF THE INVENTION

Introduction:

An ordinary alarm switch is an electric switch which—when pressed—closes a circuit to operate a siren, a camera or any other warning device. The alarm circuit could also be connected to any security office or police station. Wireless sets carried by policemen, guards and other people who work in dangerous places may be looked at as an alarm switch when used to call for help. Even the pressing of a telephone's buttons can be likened to the use of an alarm switch when someone rings the police or the ambulance to call for help.

Problems encountered in the operation of ordinary alarm switches:

All the above types of alarm switches have various deficiencies. Following are some examples:

1-Using the switch at the critical time:

The victim is required to actuate the switch just before, or while being assaulted. He is supposed to do so at the very precious time he needs to defend himself or to escape. He may be in a situation that does not enable him to reach the alarm switch. Due to confusion, his attempt may further endanger his life.

2-Situations in which the use of the alarm switch is impossible:

It is sometimes impossible for the victim to actuate the switch if he is closely threatened, injured or actually assaulted. In situations such as unconsciousness, a telephone or an ordinary alarm switch becomes useless.

3-Ordinary alarm switches do not tell the difference between "suspicion" and "actual danger" states:

Many people are deterred from actuating the alarm switch when they suspect a stranger, for fear of embarrassment if nothing happens. A patient may likewise hesitate before calling for help for the same reason, although this may be dangerous. Alarm signals made for falsely suspecting a danger, may be very disturbing.

4-Signals transmitted to call for help are usually late:

In most cases no alarm signals are transmitted to a security office or a police station before an actual assault. Therefore, it is hard to provide assistance at the proper time. Late signals do not allow the monitoring of events on a TV circuit. To overcome such a problem, security guards need to be employed for 24 hrs/day, to guard houses or private premises; which is very costly. Late signals may cause problems in case of providing help or medical advice to a sick or injured person.

BRIEF SUMMARY OF THE INVENTION

The present invention has many advantages; for it tackles the aforementioned problems associated with the use of ordinary alarm switches:

Advantages:

1. Through this device, the user can transmit an initial signal to express his/her suspicion towards a stranger; or on feeling that he/she may suffer from a coma. This initial "suspicion signal", is a valuable tool to police or security officers; for it puts them on the alert to act promptly if another "warning signal" is received. The "suspicion signal" can be cancelled by the user when he feels safe.

2. When a "suspicion signal" is transmitted, a video camera or a tape recorder operates automatically to allow for clear monitoring and judging the situation by a security guard.

3. Through this device, a "warning signal" is automatically transmitted while a victim is under assault. It is also transmitted if he falls down, gets injured or becomes unconscious.

4. However, a "warning signal" can still be transmitted manually by the user. A siren and/or other warning devices operates.

5. The "suspicion" and the "warning" signals can both be cancelled independently.

Mechanical Description:

The device comprises a hollow housing, inside which are enclosed, two switches and an actuating cylinder element. The two switches are fixed to the inner wall surface of the housing. The actuating cylinder is pivoted to the housing from one end; while extends outside the housing from the other end of the cylinder.

Inside the actuating cylinder, a third switch is enclosed, "the suspicion switch", which is fixed on the opposite end to a piston. A pressure spring is fitted inside the cylinder between the "suspicion switch" and the piston. When the user presses the device's handle—against the spring—, a rod affixed to the piston actuates the "suspicion switch". The piston reverts to its first position when the pressure is released from the handle. Because it is pivoted to the housing from one end, the actuating cylinder element can move to the right or to the left—inside the housing—, while the handle moves—outside the housing—, with its bar guided by a slot in the housing. The cylinder can actuate one switch, of those fixed to the housing—"the reaction warning switch"—when moved to the right. It can actuate the other switch—"the direct warning switch"—when moved to the left.

Electrical Description:

The present invention is a four-states warning switch. The four states are: The "idle state", the "suspicion state", the "reaction warning state" and the "direct warning state". The four-states warning switch is a device used to control two different circuits: "The suspicion circuit" and "The warning circuit". Through these two circuits distinct signals are transmitted, to be received by a police station, a security office or an ambulance. The control is achieved by three push-button switches. Any of the three switches is "ON" when pressed and "OFF" when the pressure is released. The following is the circuit control table in the four states:

Circuit Control Table

| | State of the Device | Switches Position: Suspicion Switch | Reaction Warning Switch | Direct Warning Switch | Suspicion Circuit | Warning Circuit |
|---|---|---|---|---|---|---|
| 1 | Idle State | OFF | OFF | OFF | *OPEN | OPEN |
| 2 | Suspicion State | ON | OFF | OFF | CLOSED | OPEN |
| 3 | Reaction Warning State | OFF | ON | OFF | OPEN | CLOSED |
| 4 | Direct Warning State | OFF | OFF | ON | OPEN | CLOSED |

*OPEN = no signals are transmitted
Reaction and Direct warning switches are connected in parallel Design Alternatives:

1. A pressure spring can be fitted between the inner surface of the housing and the actuating cylinder element's outer surface. The spring's function is to facilitate the actuating cylinder's movement to the right direction as shown in FIG. 5.

2. The "direct warning switch" can be fixed to the outer surface of the housing.

3. Additional switches can be fitted to serve extra warning functions.

4. A pair of terminal lugs can replace any of the switches.

5. The simplified design of the device as shown in FIGS. 19–25: In this design the device comprises only the cylinder element and two switches fitted inside it. A piston is used to actuate the "suspicion switch" when it is moved in one direction or the "warning switch" when it is moved in the other direction. The piston's movement is controlled by the device's handle; which can be shifted with its bar guided by a slot in the cylinder's surface. The warning switch in this design does the functions of both the "reaction warning switch" and the "direct warning switch". In this simplified design, any of the two switches can be replaced by a pair of terminal lugs.

6. The pivot connection between the actuating cylinder element and the housing can be altered to a longitudinal slide movement design of the actuating cylinder as shown in FIG. 15.

DETAILED DESCRIPTION OF THE INVENTION

Figure 1:
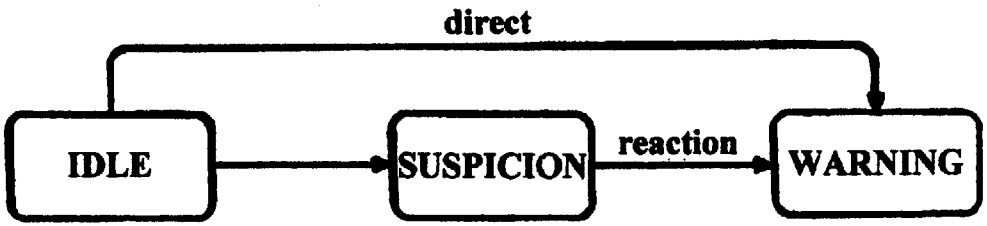
FIG. 1 is the sequence of operation chart of the device.
Figure 2:
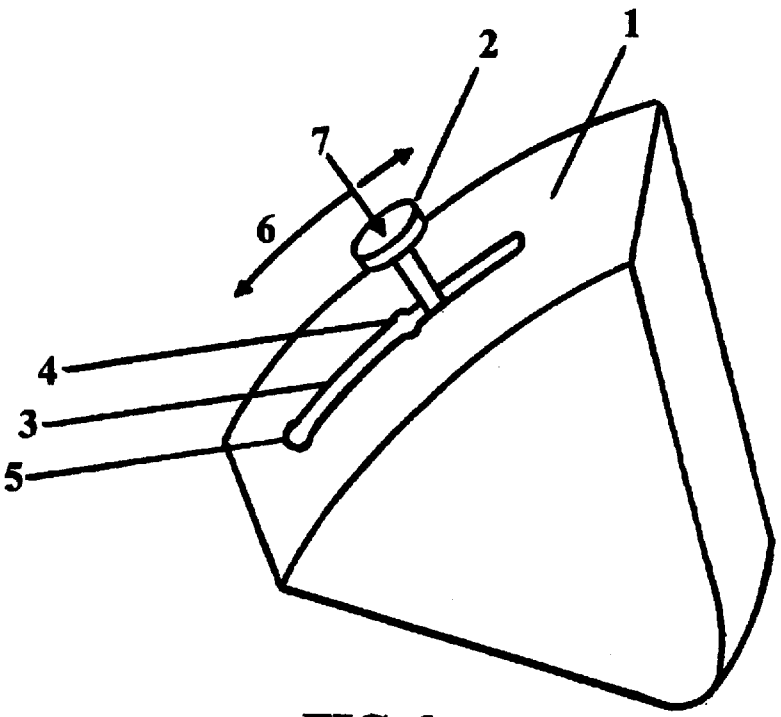
FIG. 2 is a perspective view of the device.

The outside appearance of the device is shown in FIG. 2, which is a perspective view. The device's handle 2 appears on the front side of the housing 1. The slot 3 in the front side of the housing allows the handle to move to the right or to the left, i.e., in both directions of arrow 6. There are circular openings in the slot; one in the middle 4 and the other 5 at its right end. The diameter of the two circles is larger than the slot's width. The two circles indicate the handle's location, and hence the state of the device. The handle can also move inward when pressed in the arrow 7's direction.

Figure 4:
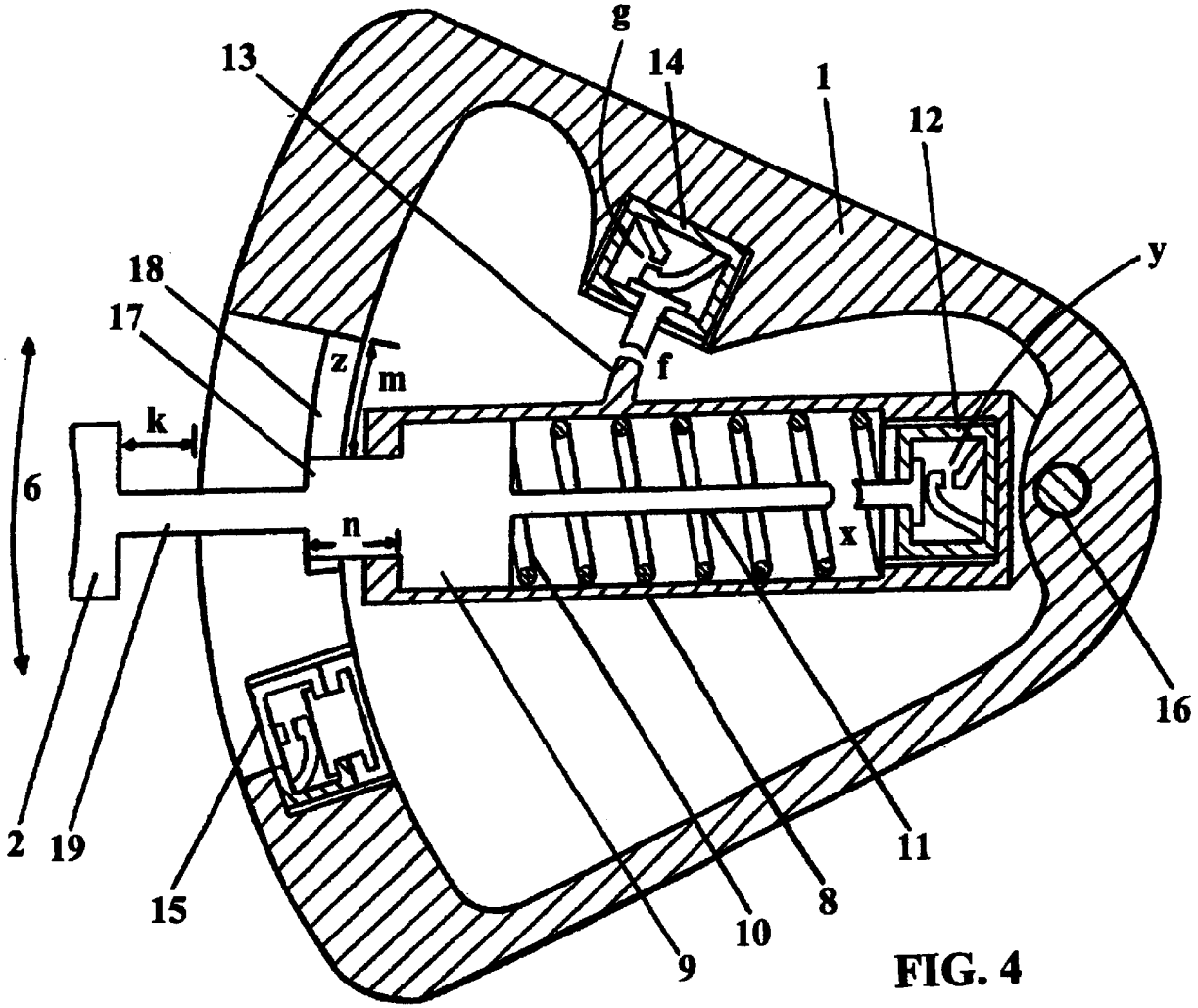
FIG. 4 is a sectional view of the device in the "idle state".

It reverts backward automatically when the pressure is released, by the action of a pressure spring 10 of FIG. 4.

Figure 3:
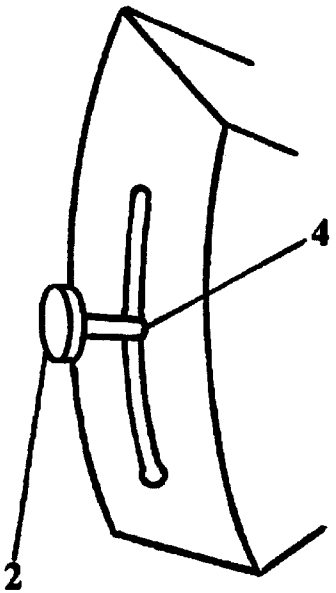
FIG. 3 illustrates the handle's position in the "idle state".

FIG. 3 illustrates the handle 2's position in the "idle state" of the device. The handle is located at circle 4 in the slot; and is not pressed. The sectional view in FIG. 4 illustrates the components of the device. The housing 1 is hollow, and encloses: the "direct warning switch" 14, the "reaction warning switch" 15 and the "actuating cylinder element" 8. The two switches 14 and 15 are fixed to the inner surface of the housing 1 as shown. The "actuating cylinder element" 8 is pivoted to the housing by the "pivot pin" 16 from one end; so it can move inside the housing. The "actuating cylinder element" 8 encloses the "suspicion switch" 12, the piston and a "compression spring" 10. The piston 9 has an extension 17, which can move along a "recess" 18 in the housing 1. The device's handle 2 has a "bar" 19, which is screwed in the piston's extension 17. The device's handle 2 can move to the right or left as shown by the direction of arrow 6, thanks to the pivot connection of the "actuating cylinder element" 8 to the housing 1 and to the groove 18 in the housing 1. The "actuating cylinder" 8 can switch on the "suspicion switch" 12 when its "piston rod" 11 presses the switch's button. The "actuating cylinder" 8 can also switch on the "direct warning switch" 14 through a "protrusion" 13 on its outer surface, by pressing the switch's button. The "suspicion switch" 12 controls the "suspicion—electric—circuit". The "warning—electric—circuit" is controlled by either the "reaction warning switch" 15 or the "direct warning switch" 14. The two switches 14 and 15 are connected in parallel.

FIG. 4 indicates that the device is in the "idle state" for non of the three switches is pressed; which means that they are all in their "OFF" position.

Figure 5:
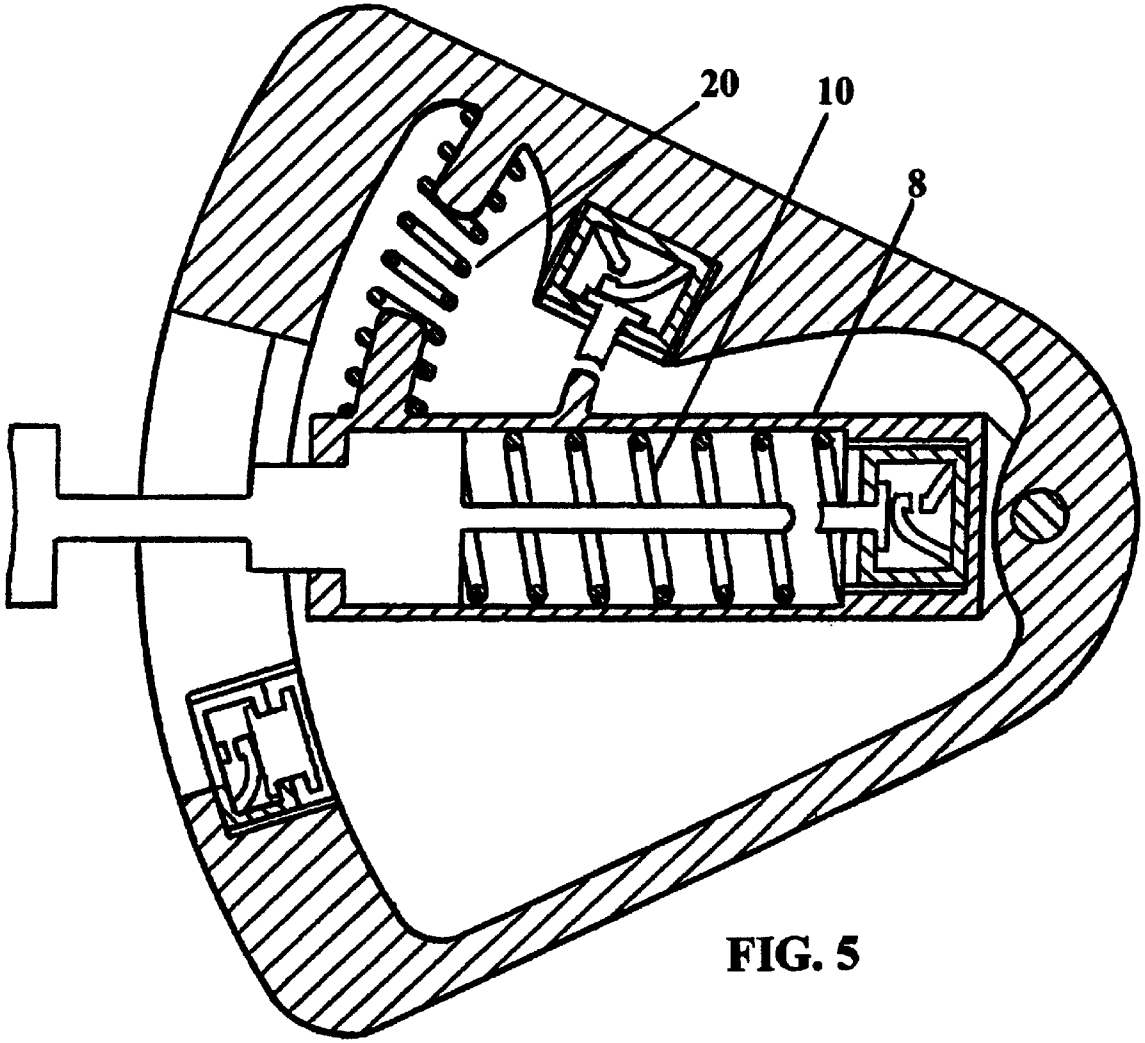
FIG. 5 is a sectional view of the device in the "idle state", showing the actuating cylinder's "external" compression spring.

FIG. 5 illustrates a design alternative whereby a "compression spring" 20 is fitted between the "actuating cylinder element" 8 and the device's housing. The function of the spring 20 is:

1-To prevent the unintentional switching on of the "direct warning switch" by pushing the "actuating cylinder element" 8 towards the opposite direction.

2-To facilitate the "actuating cylinder element" 8's movement, towards the "reaction warning switch" to switch it "ON" automatically—by the action of spring 10—when the device's handle is pressed. The components of the "actuating cylinder element" 8 are illustrated in perspective views in FIG. 6. These are: the "actuating cylinder" 8, the piston 9, the piston rod 11, the handle 2, the handle bar 19, the compression spring 10 and the "suspicion switch" 12.

Figure 8:
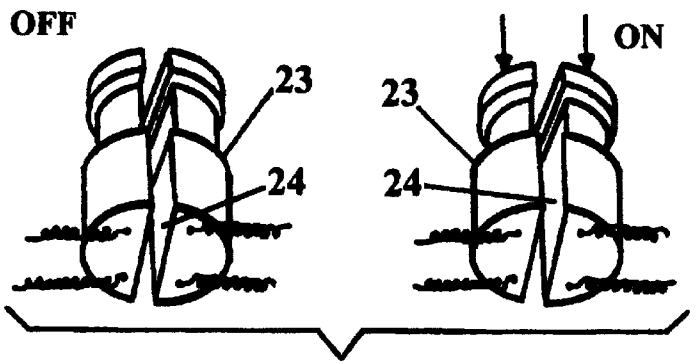
FIG. 8 is a perspective view of a dual type "reaction warning switch" in the "OFF" and "ON" positions.
Figure 7:
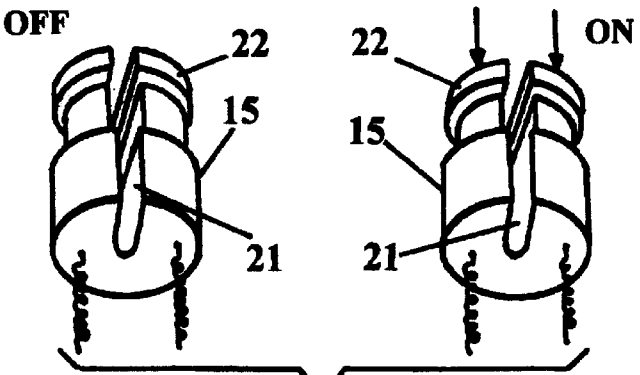
FIG. 7 is a perspective view of the "reaction warning switch" in the "OFF" and "ON" positions.

FIG. 7 is a perspective view of the "reaction warning switch" 15, which is a push button switch. When the button 22 is pressed—as shown by the two arrows—the switch is in the "ON" position; and when it is not pressed, the switch is in the "OFF" position. The "reaction warning switch "15 has a "groove" 21. When the "actuating cylinder" moves towards this switch 15, the handle bar fits smoothly in this groove 21. The "reaction warning switch" can be replaced by a "pair of switches" 23 as shown in FIG. 8. The function of the groove 21 in a single "reaction warning switch" 15 as illustrated in FIG. 7 is carried by the "space" 24 between the "pair of switches" 23.

Figure 9:
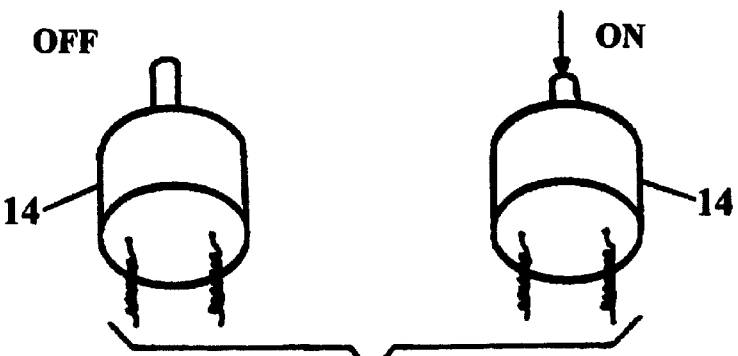
FIG. 9 is a perspective view of the "direct warning switch" in the "OFF and "ON" positions.

FIG. 9 is a perspective view of the "direct warning switch" 14 in the "ON" position on pressing the button; and the "OFF" position when it is not pressed.

Figure 10:
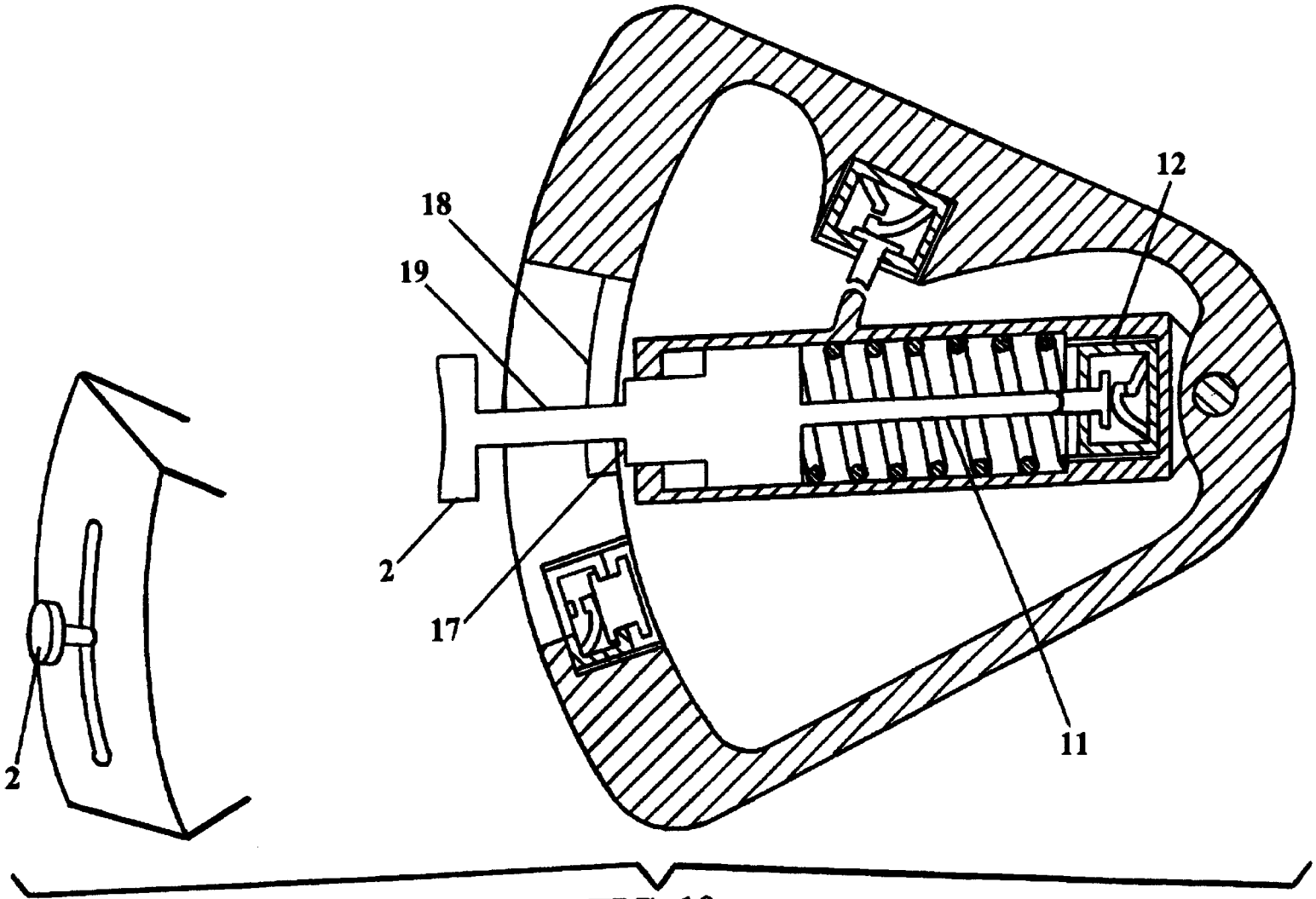
FIG. 10 is a sectional view of the device in the "suspicion state"; with a perspective view of the handle in this state.

FIG. 10 is a sectional view of the device in the "suspicion state", with a perspective view of the handle 2 in this state. When the user suspects a stranger; or feels that he/she may go into a coma or suffer from a medical problem, he presses the handle 2. Consequently, the piston rod 11 presses the button of the "suspicion switch" 12; and thus, the "suspicion circuit" is closed. A signal is transmitted and received by a security office, or a medical clinic . . . etc., so they can be ready and monitor the case carefully. Pressing the "suspicion switch" 12 can also close other circuits to operate a camcorder, a TV set, to give an advice to a patient or any other function. When the device is in the "suspicion state", the handle 2 is pressed to a limit that allows the "actuating cylinder element" to be shifted to the right direction in a later stage. Therefore, the piston's extension 17 should be released completely from groove 18. Referring to FIG. 4 this is achieved by adjusting the dimensions so that the distance between the piston rod and the button of the "suspicion switch" x, together with the compression distance of the switch y are greater than the groove 18's width z, i.e., $x+y>z$. The length of the piston's extension 17 is greater than $x+y$, i.e., $n>x+y$. The handle bar 19 has sufficient length so that $k>x+y$.

Figure 11:
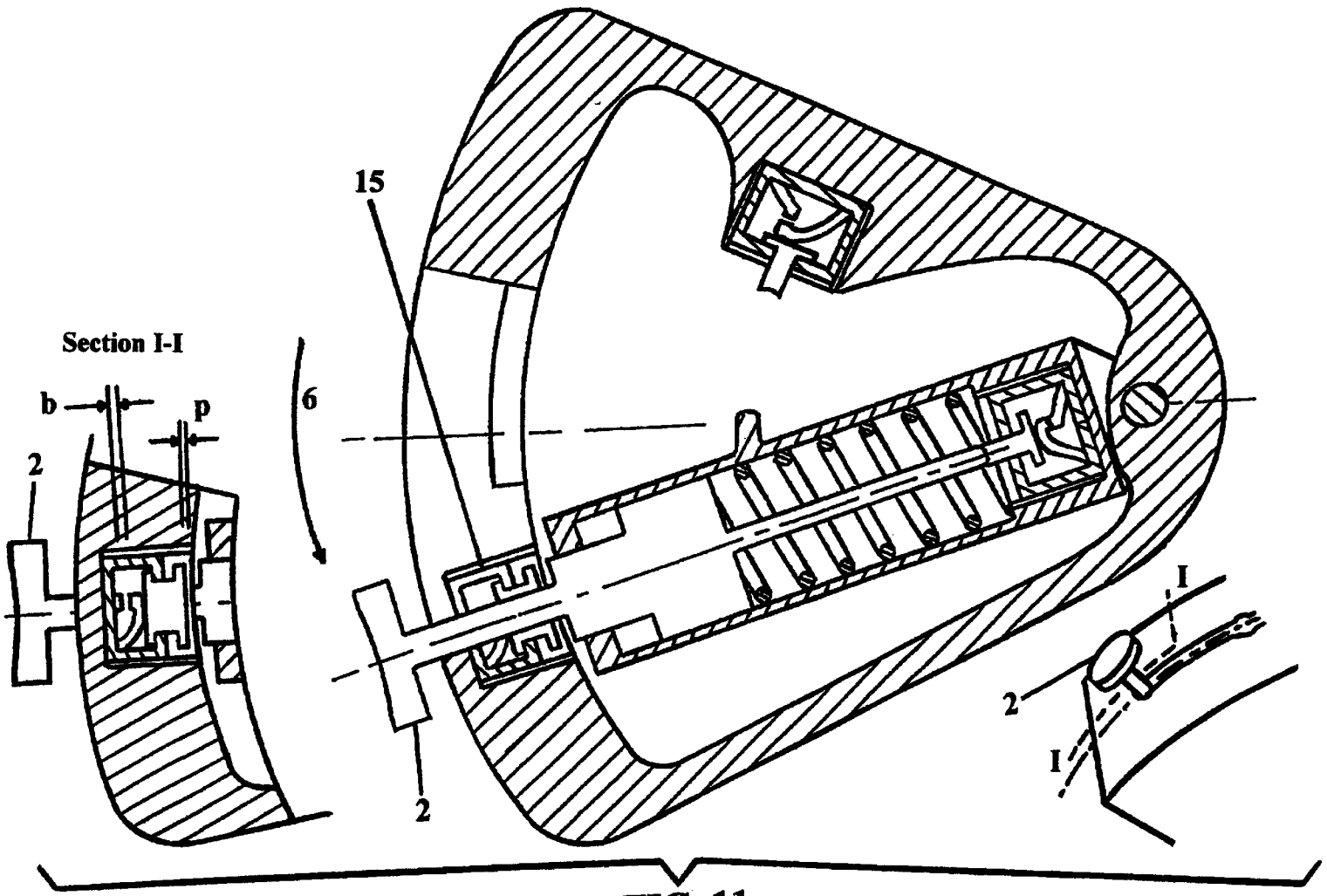
FIG. 11 is a sectional view of the device, another section I—I and a perspective view of the handle in the "suspicion state"; after shifting the handle to the right.

FIG. 11 illustrates the process of shifting the "actuating cylinder element" to the right. The user shifts the device's handle 2 to the right, in the arrow 6's direction until the handle bar fits into the groove of the "reaction warning switch" 15. This movement is only achieved if the user keep pressing the handle 2. The two sectional views show that the "reaction warning switch" 15 is in the "OFF" position, the "suspicion switch" is in the "ON" position and the "direct warning switch" is in the "OFF" position. At these settings of the three switches, the device is still in the "suspicion state".

Figure 12:
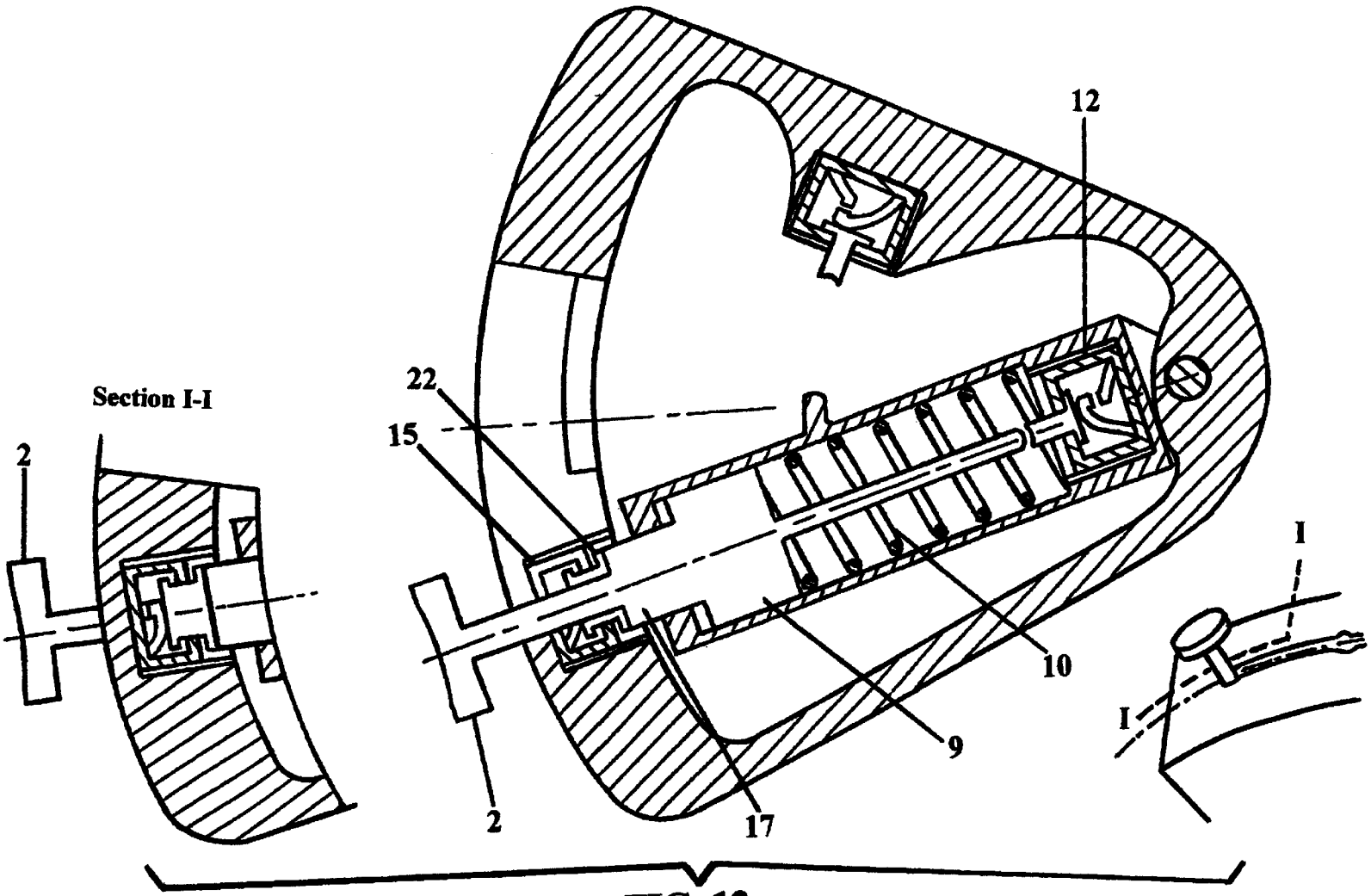
FIG. 12 is a sectional view of the device, another section I—I and a perspective view of the handle in the "reaction warning state".

FIG. 12 is a sectional view of the device, another sectional view I—I and a perspective view of the handle in the "reaction warning state". If the user stops pressing handle 2, the compression spring 10 of the "actuating cylinder" will push the piston 9 back. The piston's extension 17 will consequently push the button 22 of the "reaction warning switch" 15; so it becomes in the "ON" position. The user may release the device's handle involuntary, if he is attacked by an intruder, tries to escape, defend himself or goes into a coma. As a result of the piston's movement outwards, the pressure is released from the "suspicion switch" 12's button; and it becomes in the "OFF" position. As a result, the "suspicion signal" will stop. On the other hand, by switching "ON" the "reaction warning switch", the "warning circuit" will be closed and a "warning signal" will be transmitted and received by a police station, a security office or an ambulance. Such a signal means that the user is in danger for being assaulted or in serious medical condition. The "reaction warning switch" can close other circuits to operate a camcorder, a siren . . . etc.

The mechanism of actuating the "reaction warning switch" can only be effected successfully if the force of "compression spring" 10 on the piston 9 is greater than the force required to press the button 22 of the "reaction warning switch". The stroke $x+y$ of piston 9 must also be greater than the sum of the compression distance b of the "reaction warning switch" and the clearance p between the piston's extension 17 and button 22, i.e., $x+y>p+b$. These distances are shown in section I—I of FIG. 11. There is a different scenario if the user—while in the "suspicion state" of the device—does not release handle 2 either involuntary or intentionally. This happen when the user becomes no longer suspicious of being a target of an attack or of going into a coma . . . etc. In this case, the user will shift the "actuating cylinder element" to the left until the handle bar reaches the middle circle 4 of the slot, as shown in FIG. 3. On doing so, the user must keep pressing handle 2 until its bar reaches its final location, where he releases the handle. By the action of spring 10, the piston 9 will revert to its original position. Consequently, the piston rod will be no longer pressing the push button of the "suspicion switch" 12. When this switch is in the "OFF" position, the "suspicion circuit" opens and the "suspicion signal" stops. This brings the device back to its "idle state" as shown in FIG. 4.

Figure 13:
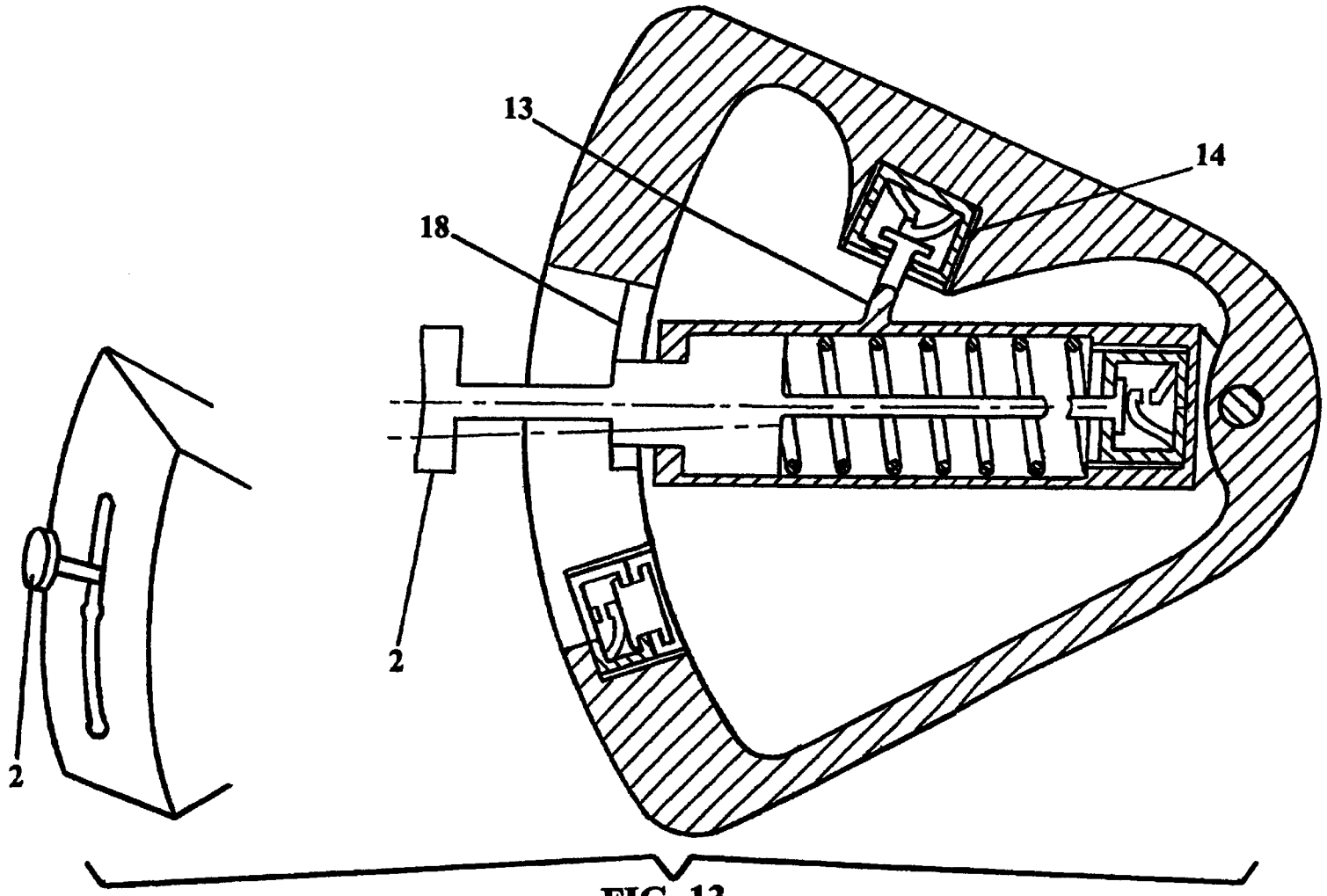
FIG. 13 is a sectional view of the device with a perspective view of the handle in the "direct warning state".

FIG. 13 is a sectional view of the device, with a perspective view of the handle in the "direct warning state". Direct warning is one of the prime functions of this device, through which the user can face a sudden or unexpected danger of any type. In this case the user will shift handle 2 of the device towards left—as shown in FIG. 13—until the "protrusion" 13 on the outer surface of the actuating cylinder presses the push button of the "direct warning switch" 14. When this switch is in the "ON" position, the "warning circuit" becomes closed; and a "warning signal" is transmitted and received by a police station, a security office or by the ambulance. In the direct warning state, the "warning signal" is not preceded by a "suspicion signal". For successful actuation of the "direct warning switch" 14, the length m of groove 18—as shown in FIG. 4—must be greater than the sum of distance f—between "protrusion" 13 and the button of the "direct warning switch" 14—and the pressing distance g of switch 14, i.e., $m>f+g$.

Figure 14:
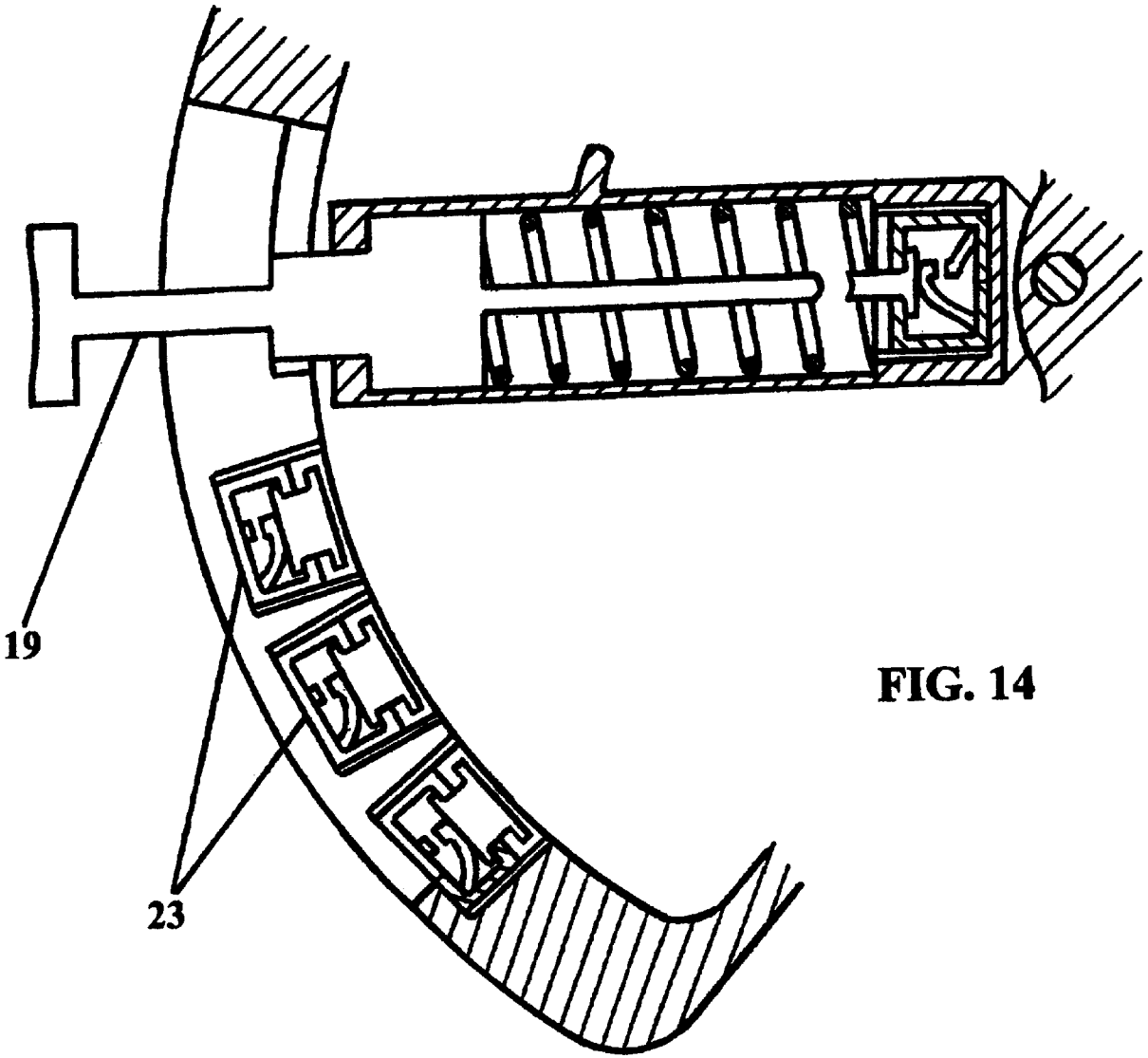
FIG. 14 is a sectional view of the device with additional switches fitted.

FIG. 14 is a sectional view of the device with additional switches fitted. Additional switches 23 are fitted as a design alternative to serve extra warning functions. An example is the classification of warning signals as "dangerous", "very dangerous", . . . etc., by security people. In this case, switches 23 should be of the split type shown in FIG. 8, so that the handle bar 19 can freely pass through them to the desired spot.

Figure 15:
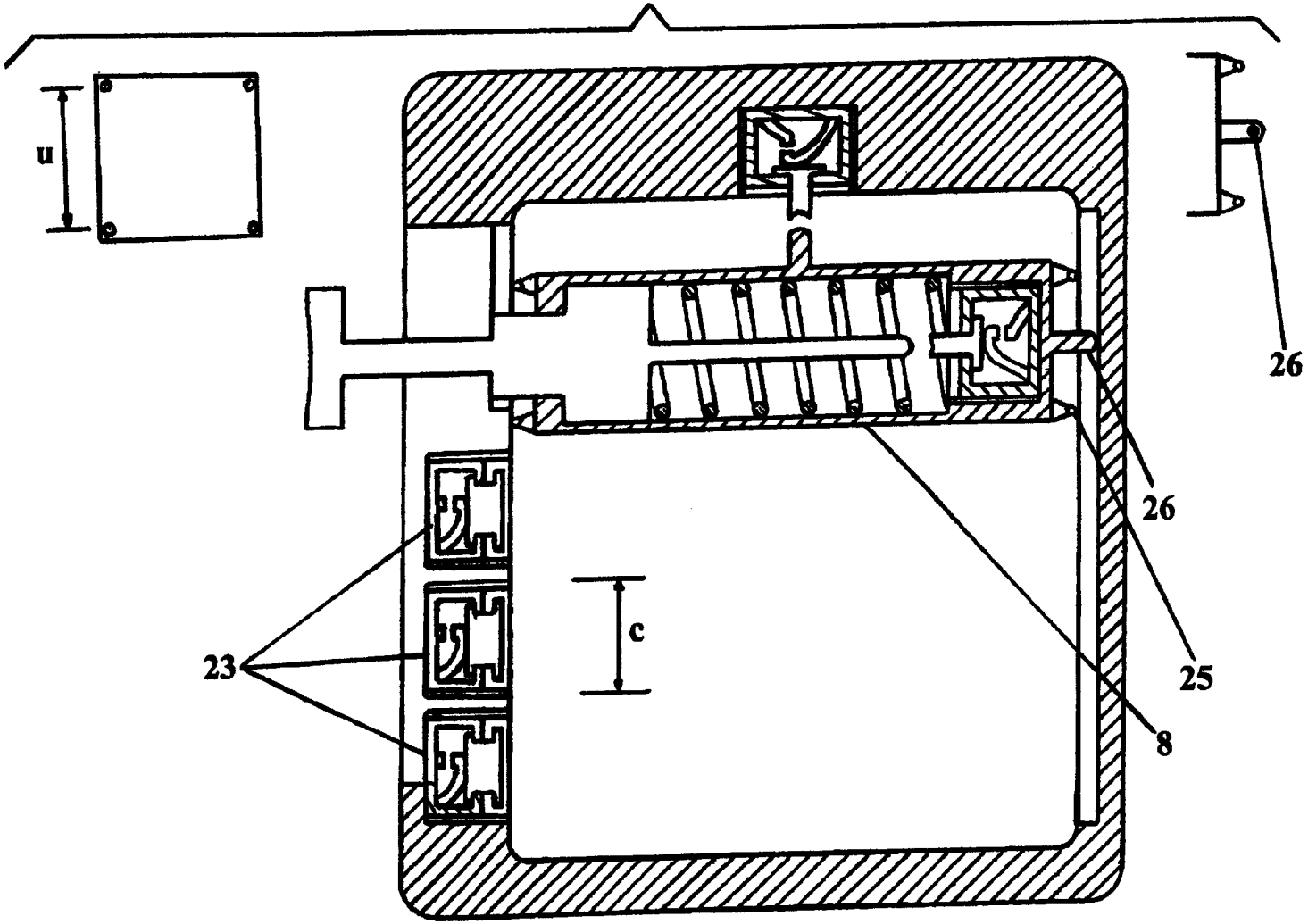
FIG. 15 is a sectional view of the device, with a longitudinal slide movement design of the actuating cylinder.

FIG. 15 is a sectional view of the device where a design alternative is shown. In this design the pivot connection between the "actuating cylinder element" 8 and the housing is altered to a longitudinal slide movement design of the actuating cylinder. Sliding is effected through bearings 25, sharp edged guide 26 or both; in order to minimize friction. In this design, the distance between the actuating cylinder's bearings u, should be greater than any of switches 23's diameter c to avoid abstracting the movement of the actuating cylinder, i.e., $u>c$.

Figure 16:
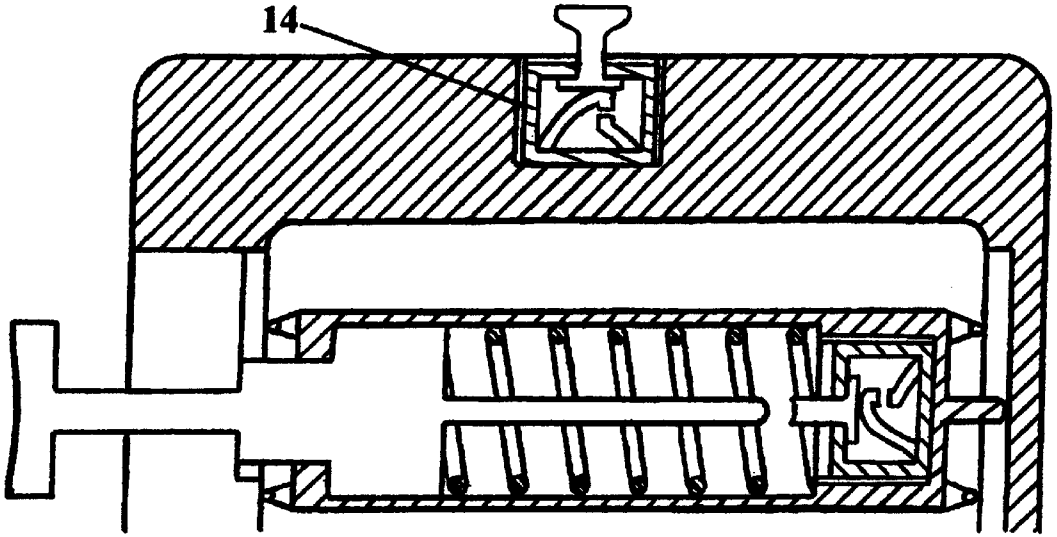
FIG. 16 is a sectional view of the device with an external fixation design of the "direct warning switch" on the outer surface of the housing.

FIG. 16 is a sectional view of an alternative design of the device with external fixation of the "direct warning switch" 14 on the outer surface of the housing. In this design the user can push the switch's button directly.

Figure 6:
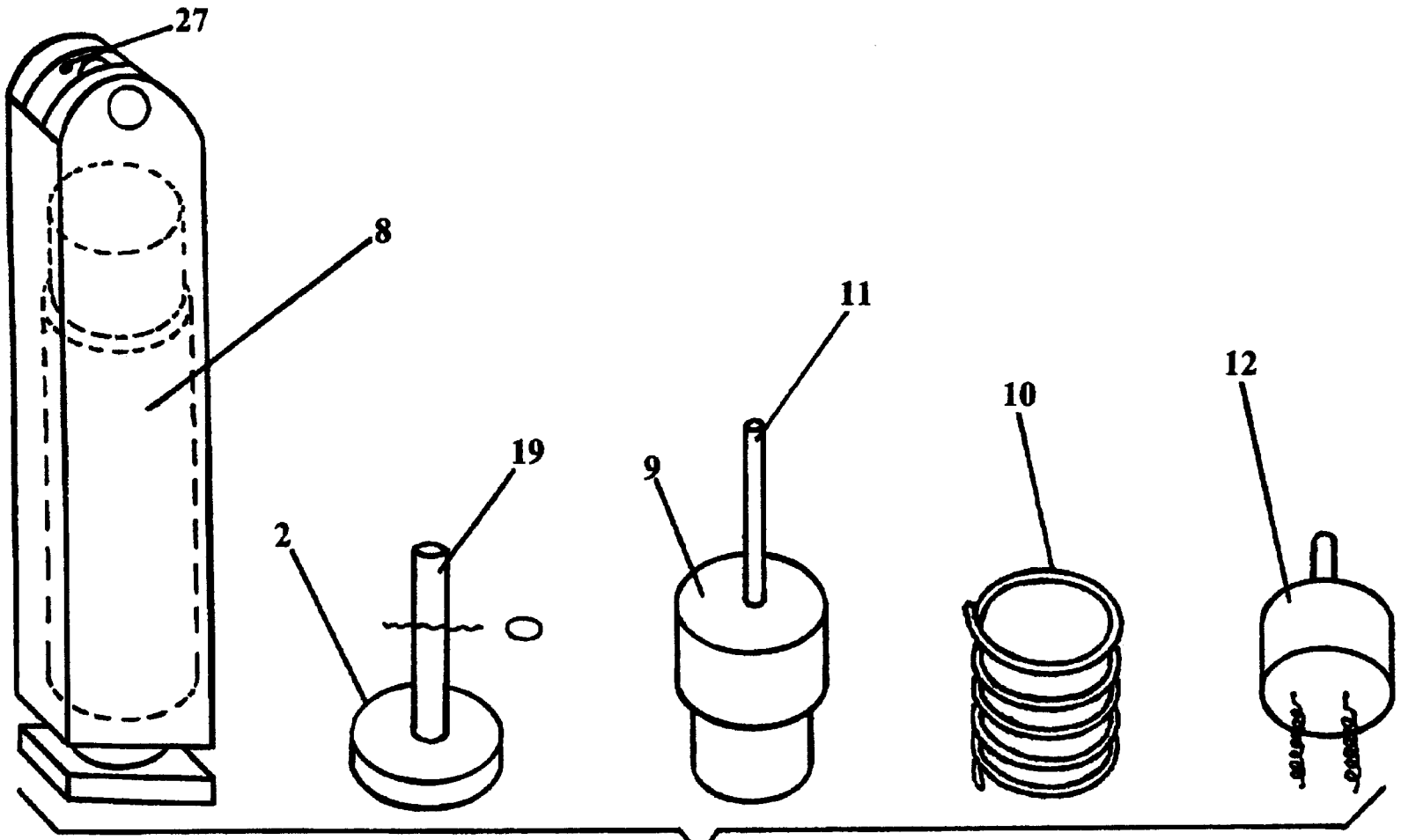
FIG. 6 is a perspective view of the actuating cylinder and its components; the piston, the "internal" spring, the "suspicion switch" and the handle.
Figure 17:
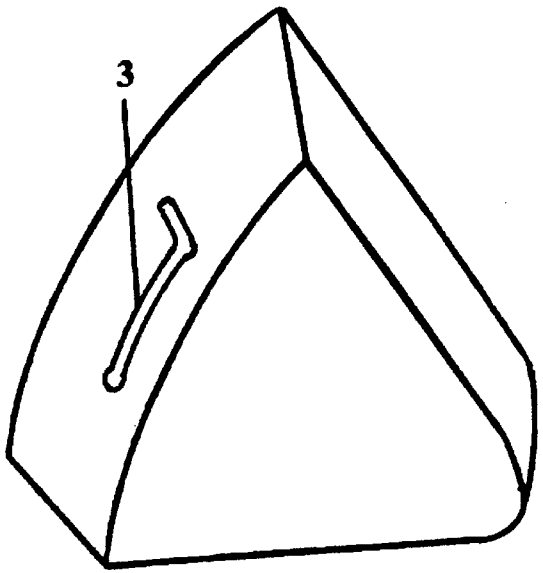
FIG. 17 is a perspective view of the housing with an angle slot design.
Figure 18:
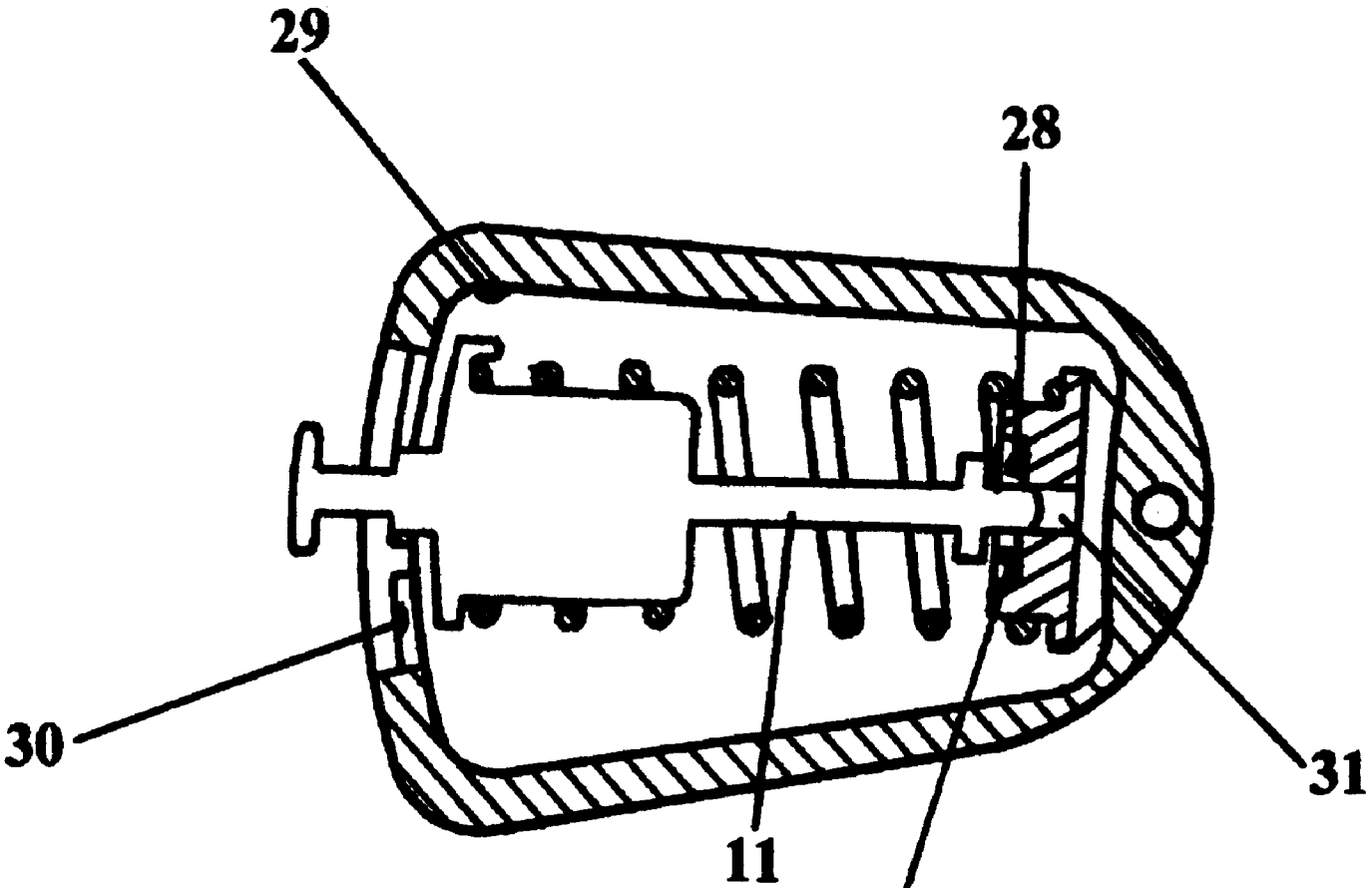
FIG. 18 is a sectional view of the device with a small dimension design in which: the switches are replaced by pairs of terminal lugs and the actuating cylinder removed.

FIG. 17 is a perspective view of the housing with an angle slot design. In the straight line design of slot 3, it is possible that the user may shift the handle of the device far to the left and actuate the "direct warning switch" unintentionally, instead of stopping at the idle state location. In the alternative design of the angle slot, this could be avoided. However, this design will require a modification to the pivot connection of the "actuating cylinder" and the position of the "direct warning switch". The electric connections of the "warning circuit" are simple, thanks to the two stationary "reaction warning switch" and "direct warning switch". The "suspicion circuit" is connected to the "suspicion switch" 12 through two terminal lugs 27 as shown in FIG. 6, or two terminal lugs 26 as shown in FIG. 15. Flexible wire can be used directly. To minimize the dimensions of the device, the switches can be replaced by pairs of terminal lugs as shown in FIG. 18. The two terminal lugs 28 control the "suspicion circuit"; which becomes closed on pressing the device's handle. The piston rod 11 effects the connection when its tip fits in hole 31. The two terminal lugs 29 and two terminal lugs 30 control the "warning circuit". It should be noted that, although the actuating cylinder is removed in this design alternative, its piston and spring are used and their dimensions are maintained.

Figure 19:
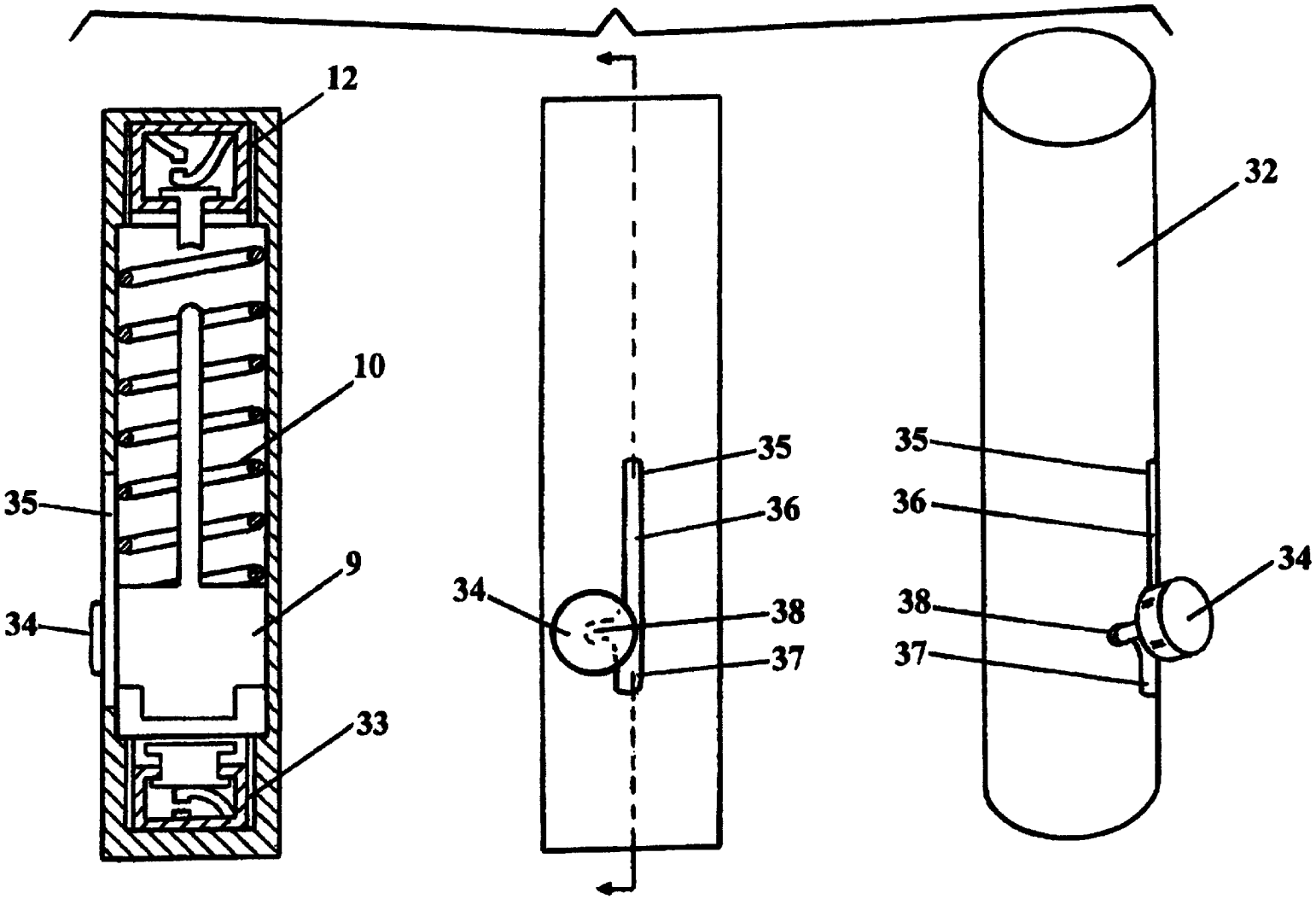
FIG. 19 is a perspective view of the simplified design of the device, an elevation and a sectional side view.

FIG. 19 is a perspective view of a simplified, alternative design of the device, an elevation and a sectional side view. In this design the housing is eliminated, so the device comprises only the "actuating cylinder" 32 and its components. These are the piston 9, the compression spring 10, the "suspicion switch " 12 and the "warning switch" 33. The piston 9 can be moved inside the cylinder in both directions using the handle 34, whose bar is fixed to the piston and moves along a slot 35 in the cylinder's surface.

This slot has an upper part 36, a lower part 37 and a horizontal side part 38. Portion 37 of the slot is wider than portion 36. When the handle 34 is located in the side portion 38 of the slot, the device is in its "idle state".

Figure 20:
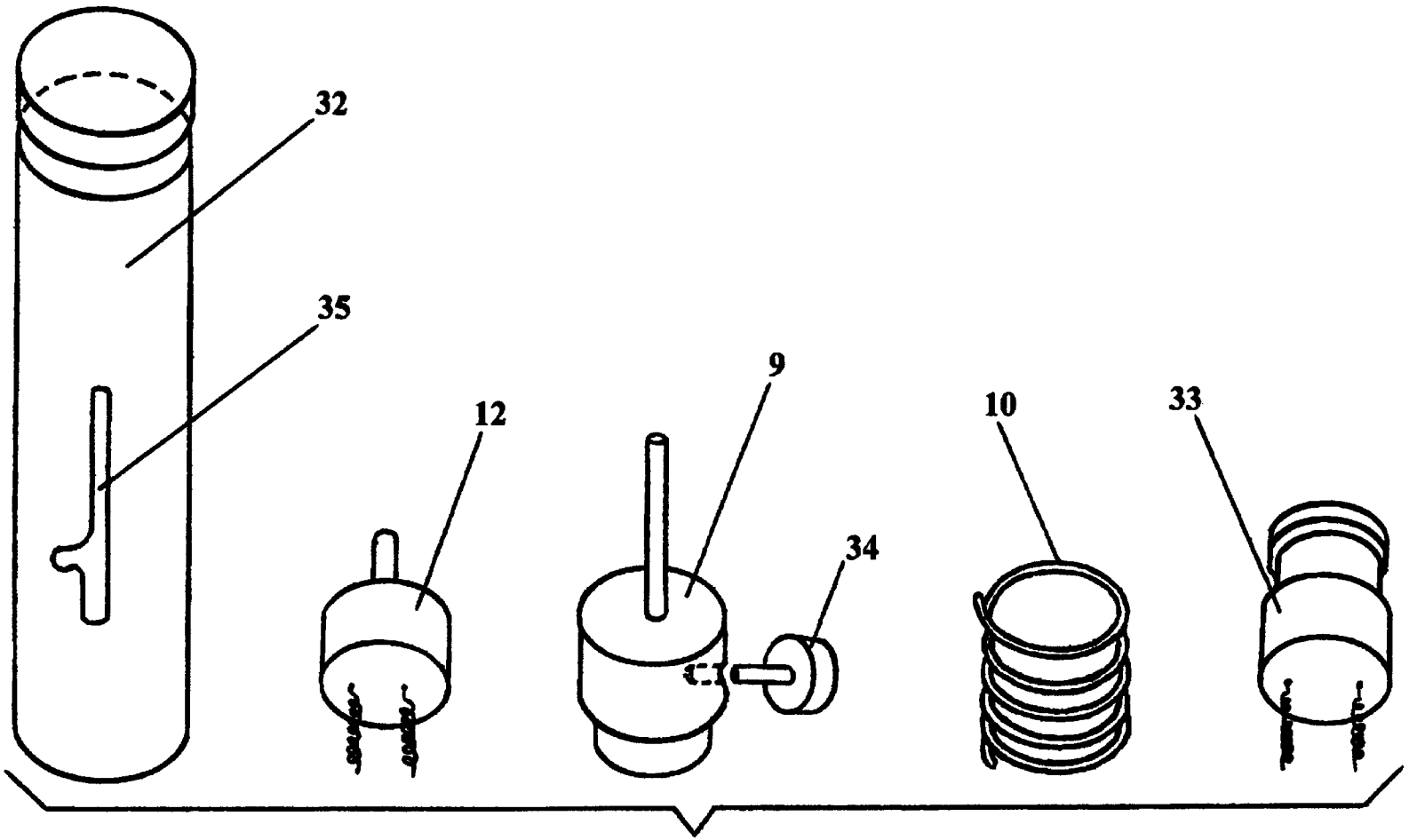
FIG. 20 is a perspective view of the simplified design of the device and its components: the piston, the spring, the "suspicion switch" and the "warning switch".

FIG. 20 is a perspective view of the simplified design of the device; with its components shown separately in FIG. 19.

Figure 21:
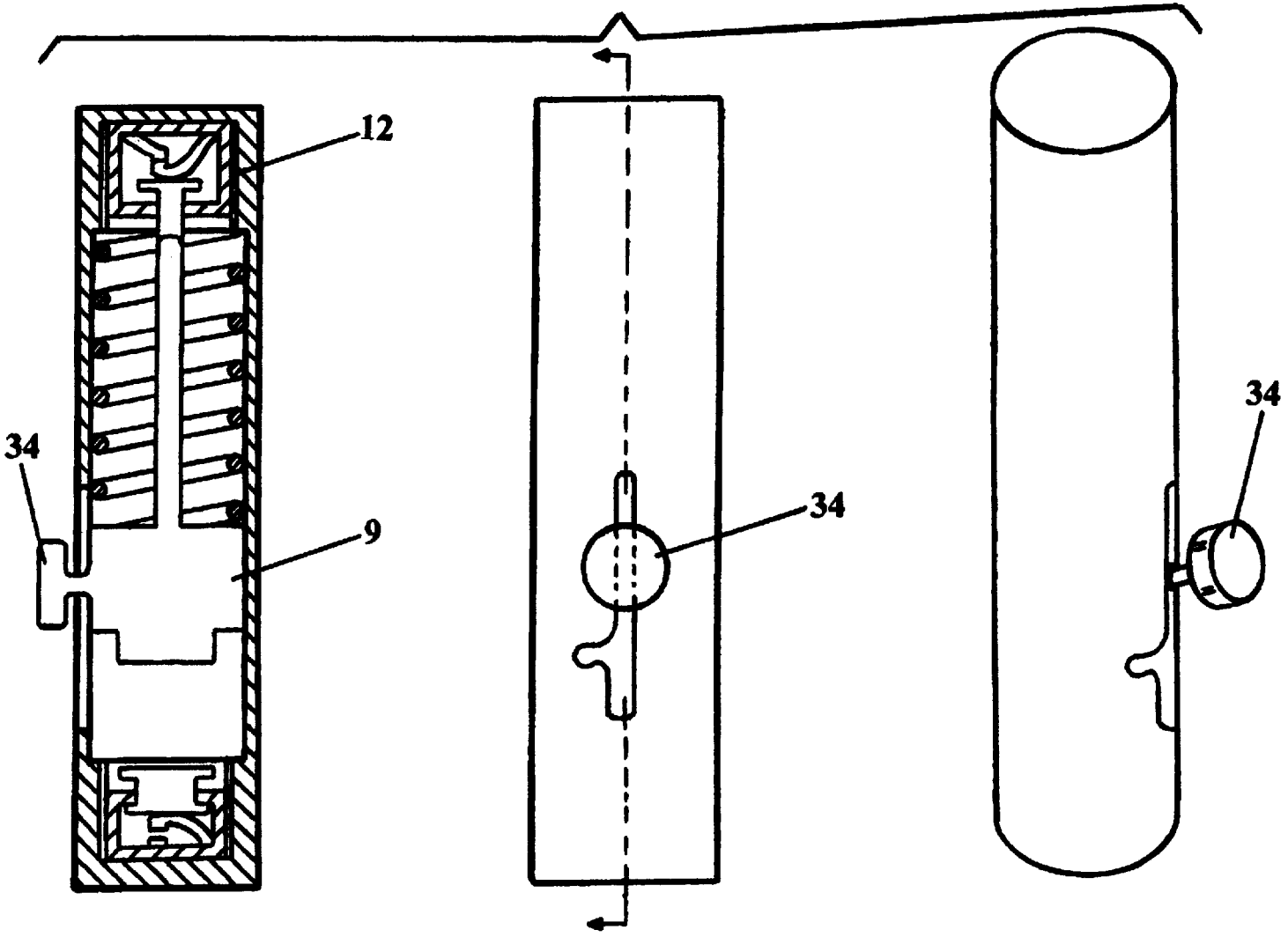
FIG. 21 is a perspective view, an elevation and a sectional side view of the simplified design of the device in the "suspicion state".
Figure 22:
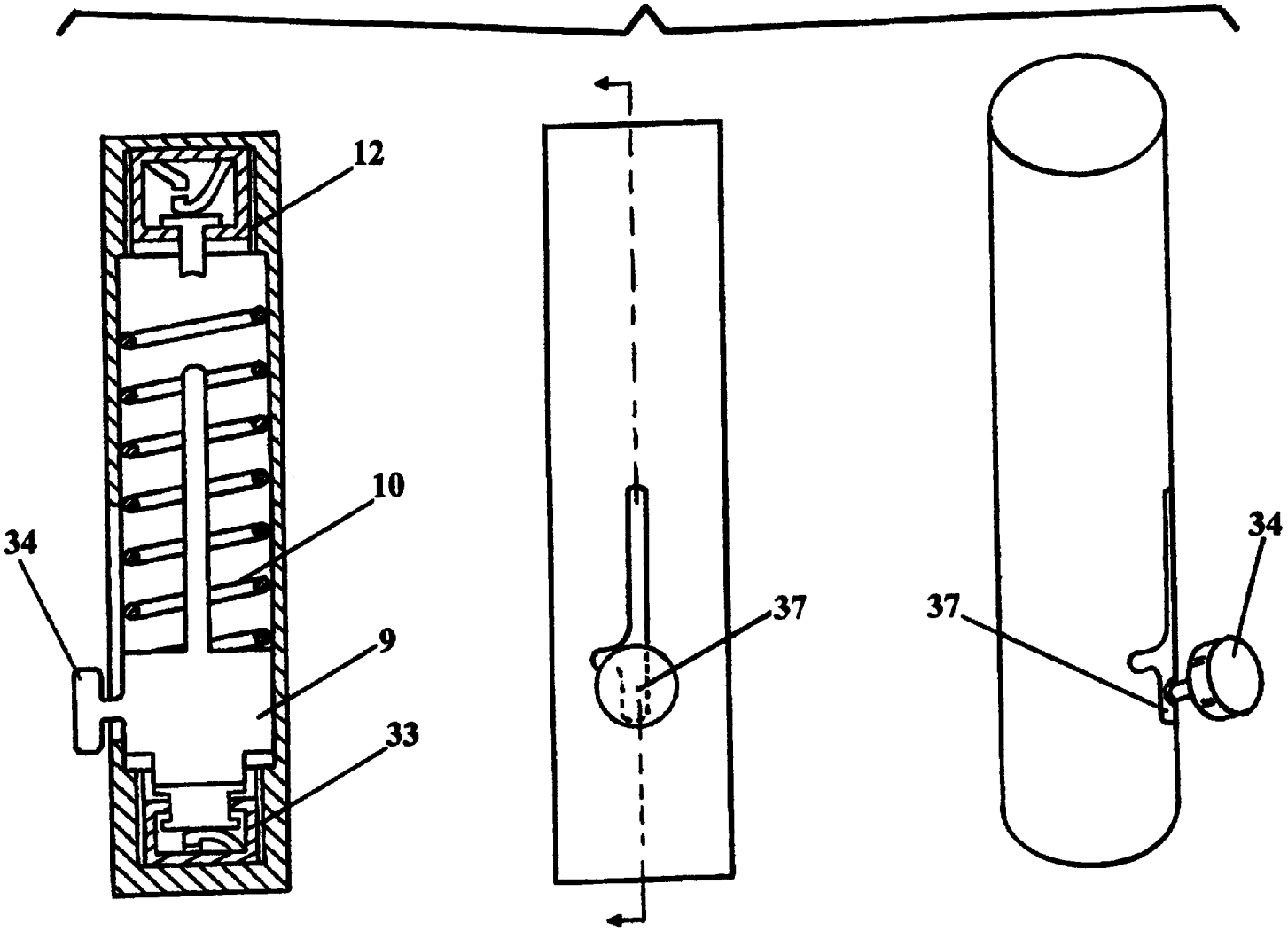
FIG. 22 is a perspective view, an elevation and a sectional side view of the simplified design of the device in the "reaction warning state".
Figure 23:
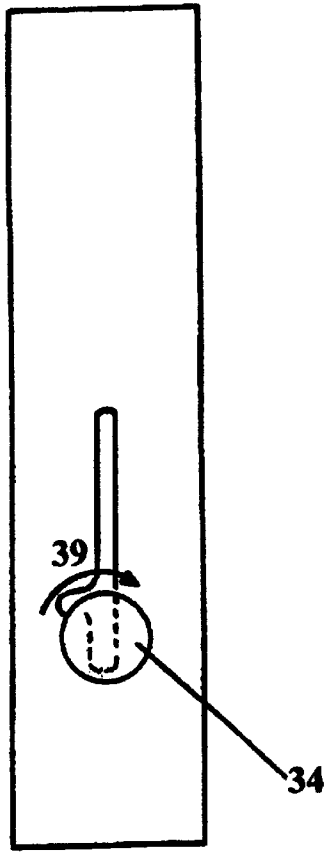
FIG. 23 is an elevation view of the simplified design of the device in the "direct warning state".

FIG. 21 is a perspective view, an elevation and a sectional side view of the simplified design of the device in the "suspicion state". To bring the device to this state, the user shifts the handle 34 upwards, so that piston 9 presses the button of the "suspicion switch" 12 to close the "suspicion circuit". The user should maintain the handle at this position until he/she feels safe. If the user is attacked or goes into a coma, he/she may involuntarily release the handle 34. Piston 9 will be automatically pushed down—by the action of the spring 10 as shown in FIG. 22—to press the button of the "warning switch" 33; and close the "warning circuit". The wide portion of the slot 37, facilitates the handle—and the piston's—movement downwards. Due to the piston's movement, the "suspicion switch" 12 reverts to the "OFF" position. An illustration of the simplified design of the device at the "reaction warning state" is shown in FIG. 22. The figure is a perspective view, an elevation and a sectional side view. The user may shift the handle 34 of the device manually from the "suspicion state" position to its "idle state" position when he feels safe; and thus the "suspicion signal" stops. The user may also bring the device to the "direct warning state" by shifting handle 34 downwards from its idle position, as shown by the arrow 39 in FIG. 23.

Figure 24:
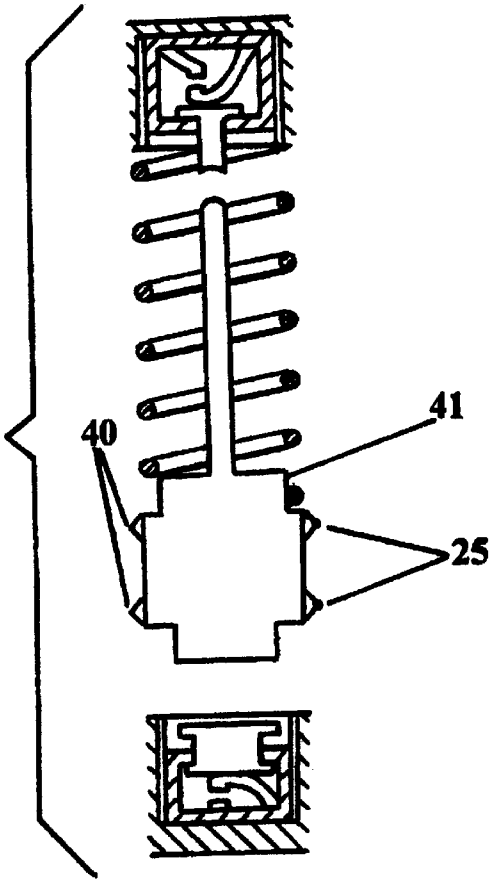
FIG. 24 is a sectional view of the piston in the simplified design of the device; with piston movement facilitated by bearing or sharp edges.

FIG. 24 is a sectional view of the piston in the simplified design of the device, where bearings 25 or sharp edges 40 are used to facilitate its movement and minimize friction. In this case a smaller diameter portion 41 is made in the piston to fit it into the spring.

Figure 25:
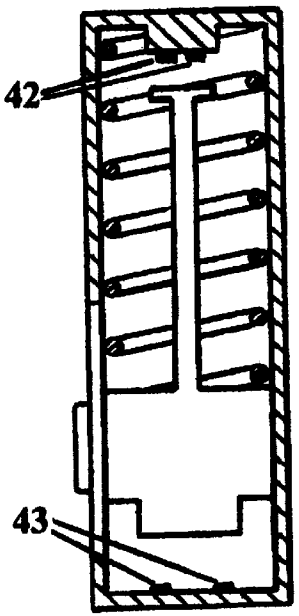
FIG. 25 is a sectional view of the simplified design of the device; with the switches replaced by terminal lugs.

FIG. 25 is a sectional view of the simplified design of the device, with the switches replaced by terminal lugs. The two lugs 42 control the "suspicion circuit", while the two lugs 43 control the "warning circuit".

FIGS. 26, 27, 28, 29 and 30 illustrate various locations, where the device can be fixed and "wirely connected" to the "suspicion" and "warning circuits".

Figure 26:
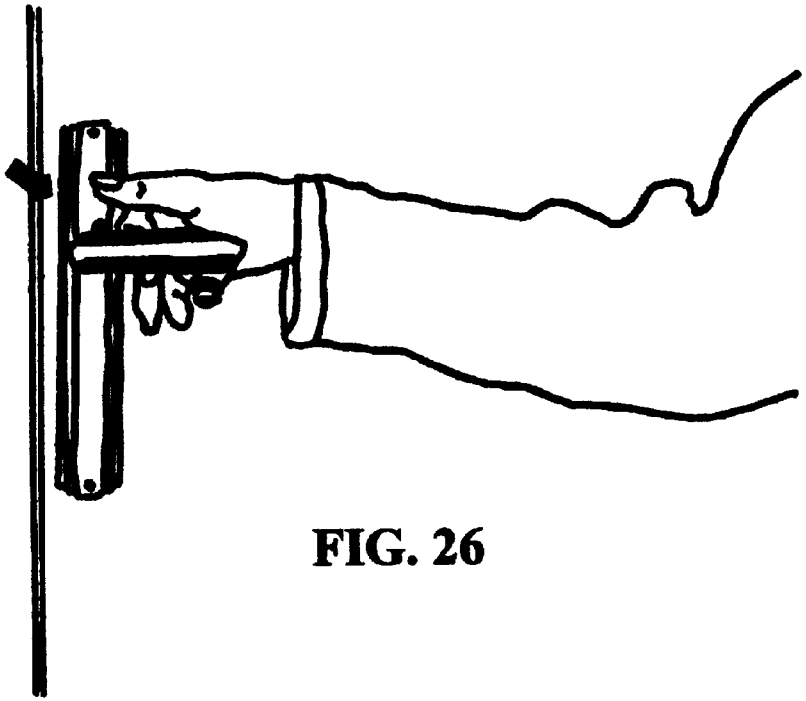

FIG. 26 illustrates how can the device be fixed in a door handle.

Figure 27:
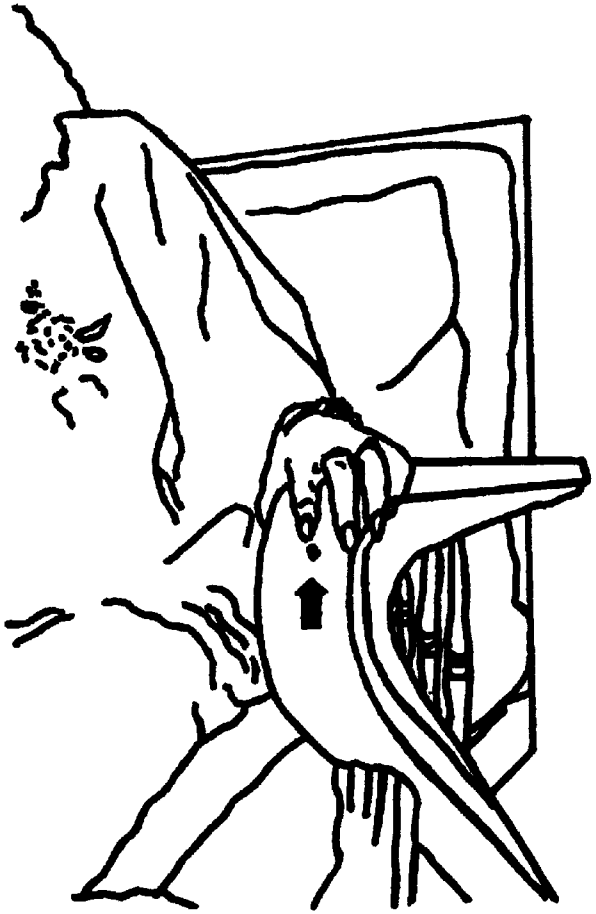
FIGS. 26,27,28,29 & 30 illustrate various locations, where the device is fixed and "wirely" connected to the suspicion and warning circuits.

FIG. 27 illustrates how can the device be fixed to the arm of a chair.

Figure 28:
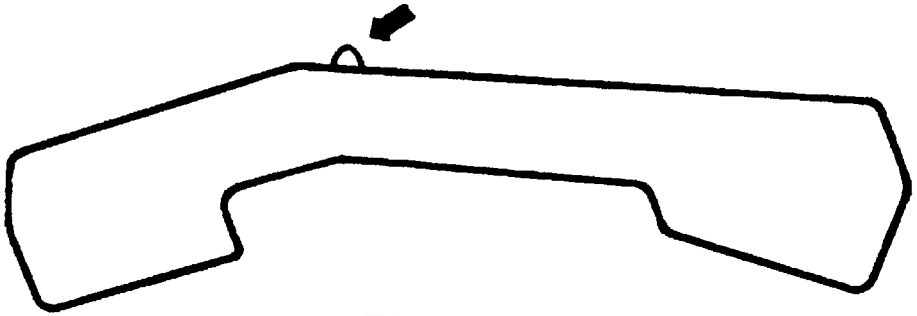

FIG. 28 illustrates how can the device be fixed to the handset of a telephone.

Figure 29:
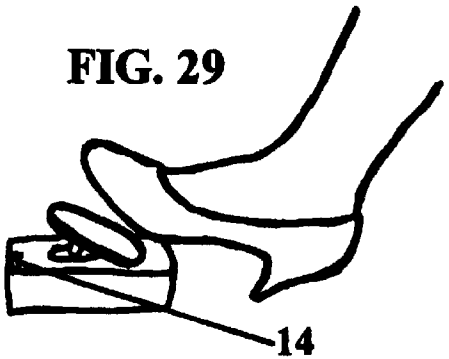

FIG. 29 illustrates how can the device be actuated through a pedal. The button of the "direct warning switch" 14 is shown.

Figure 30:
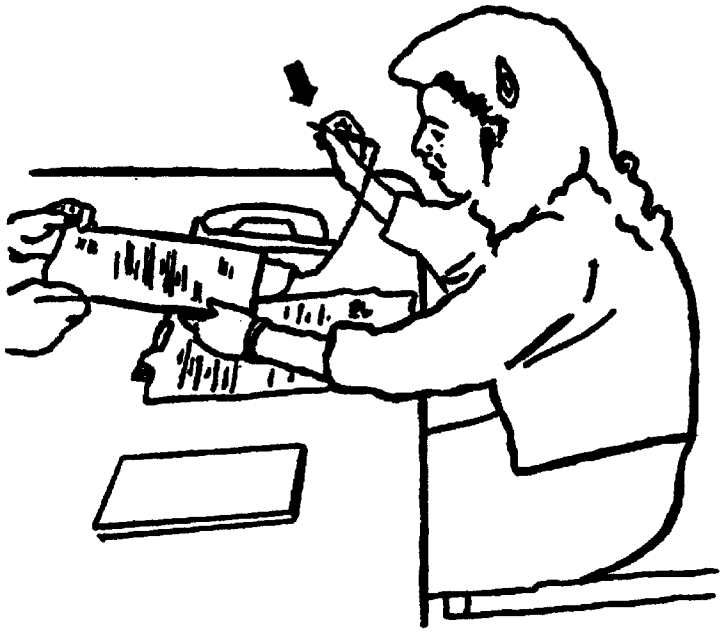

FIG. 30 illustrates how can the device take the form of a part of a pen.

Figure 32:
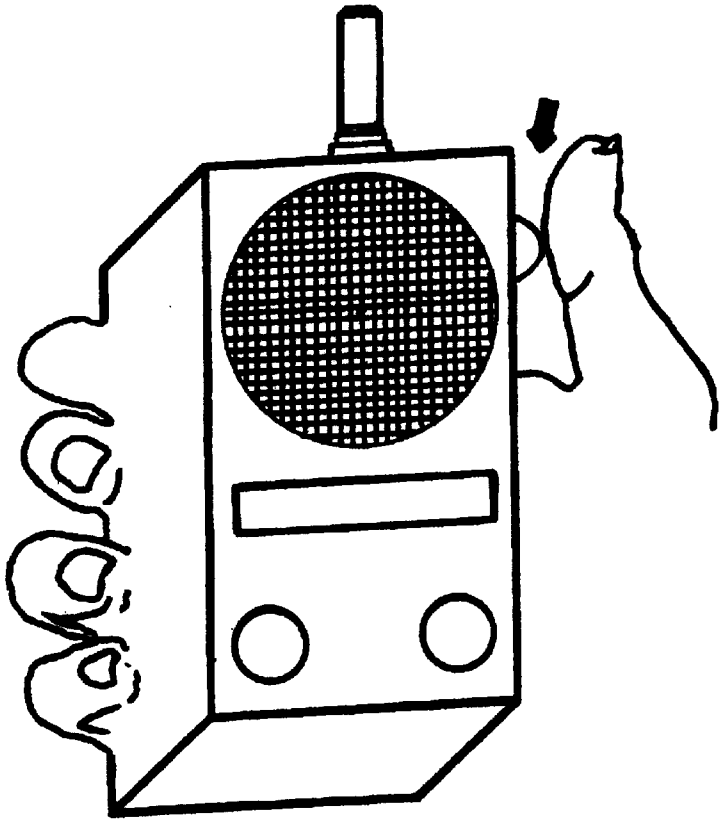
FIGS. 31,32 & 33 illustrate various locations, where the device is fixed and is wirelessly connected to the suspicion and warning circuits.
Figure 31:
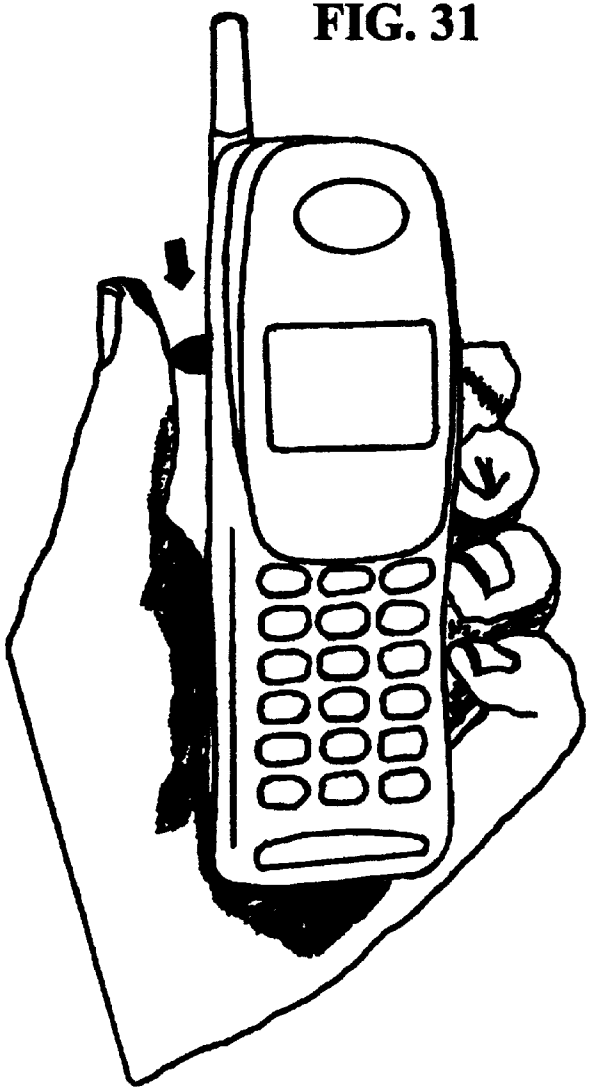
Figure 33:
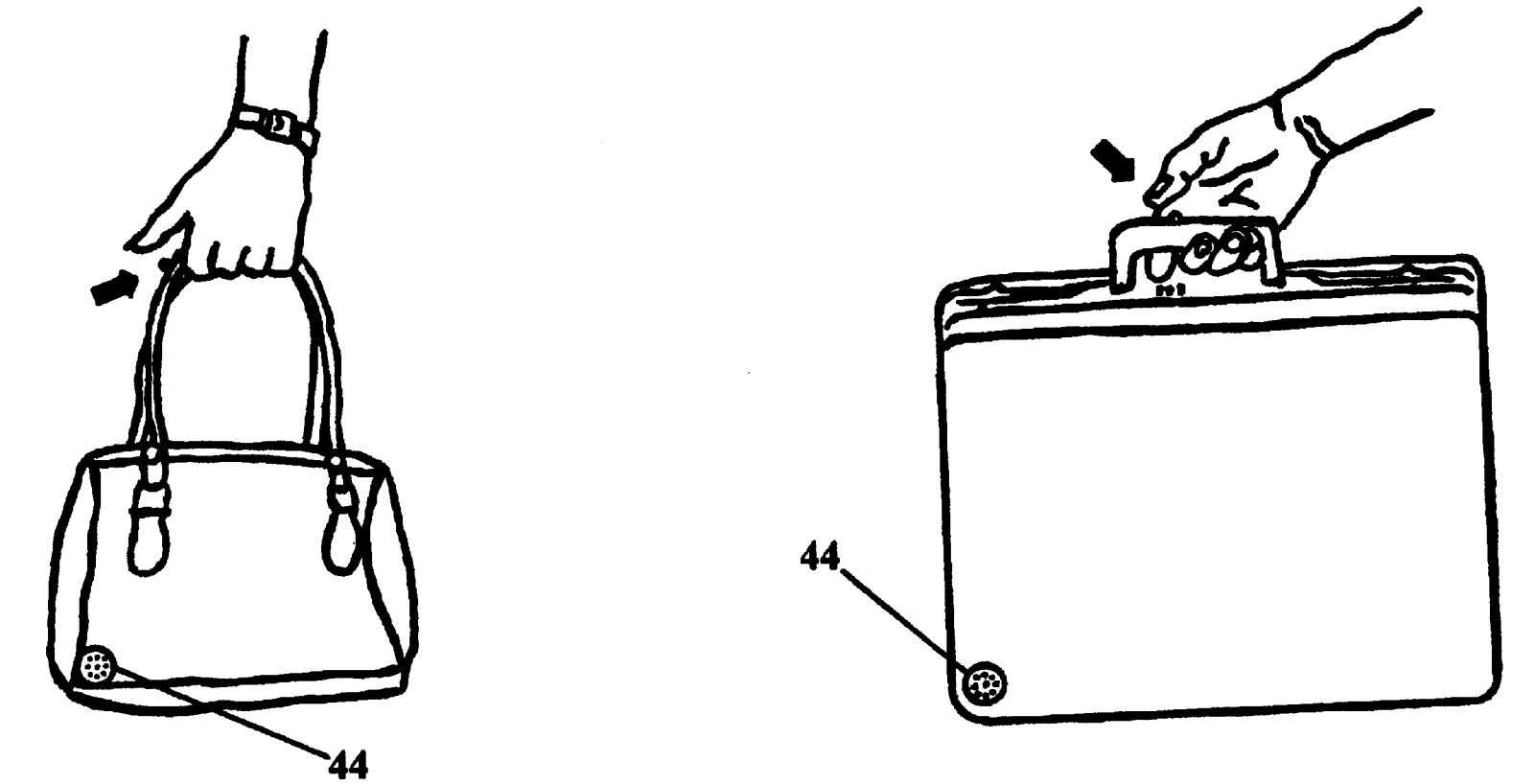

FIGS. 31, 32 and 33 illustrate various locations, where the device is fixed and wirelessly connected to the suspicion and warning circuits.

FIG. 31 illustrates how can the device be fixed to a mobile telephone.

FIG. 32 illustrates how can the device be fixed to a "radio" set.

FIG. 33 illustrates how can the device be fixed to a bag or a briefcase. A small circle 44 is perforated to facilitate the transmission of wireless signals. A siren can be connected to the device and placed inside the bag or briefcase to operate in the "warning state". The siren is very helpful in case the bag is snatched by a thief, for he can be easily detected wherever he goes.

Figure 34:
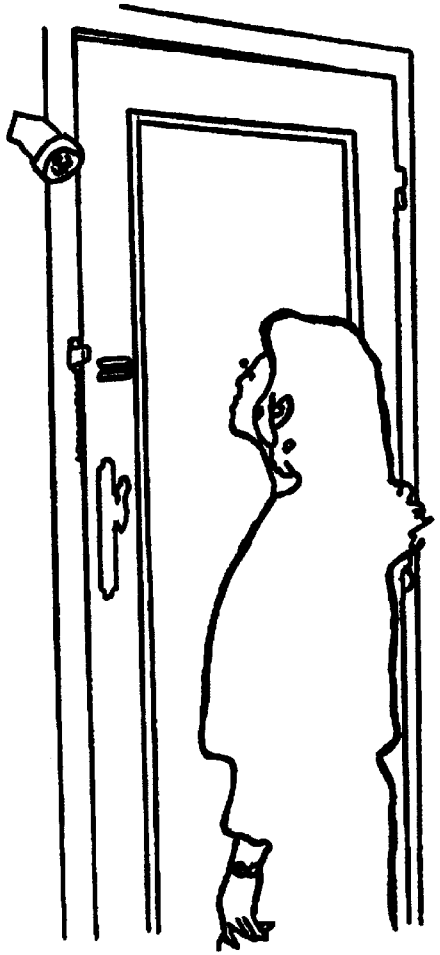

FIGS. 34, 35, 36 and 37 illustrate the sequence of events on using the device when the device's user is attacked by an intruder. The scenario is as follows:

FIG. 34: A stranger knocks the door, giving an invented excuse.

Figure 35:
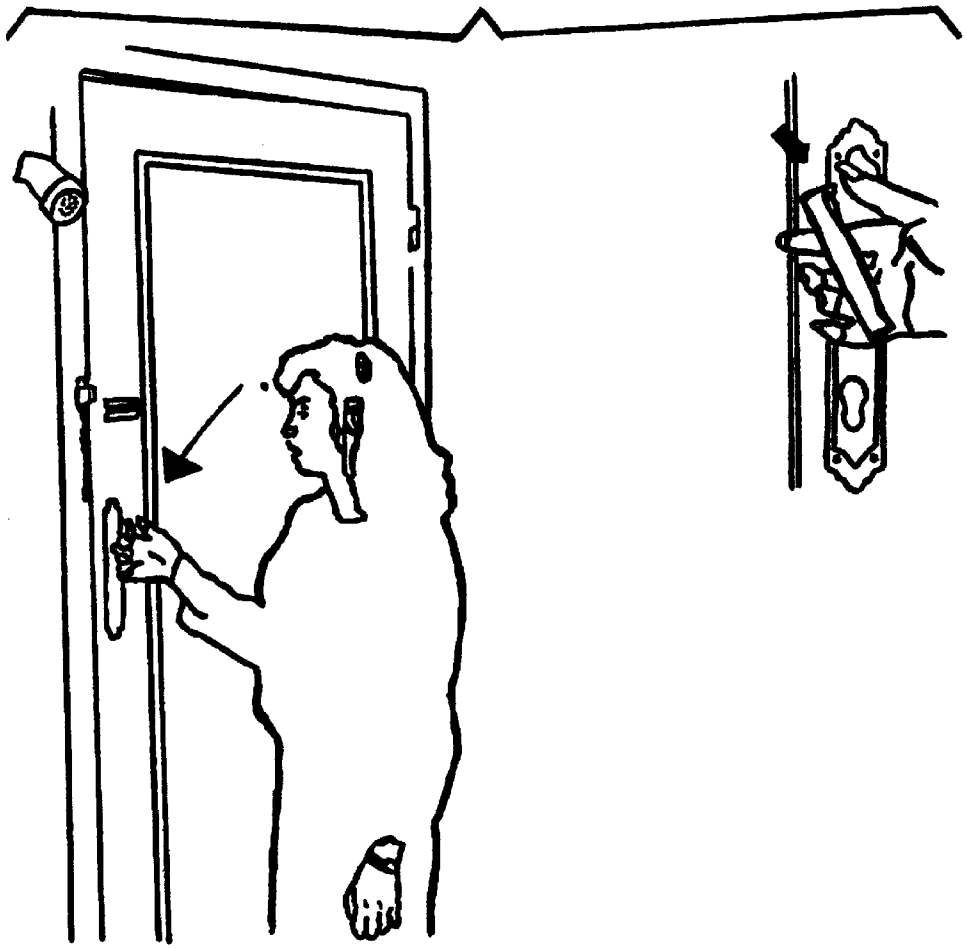
FIGS. 34,35,36 & 37 illustrate the sequence of events, on using the device when an intruder attacks someone.

FIG. 35: The user brings the device—which is fixed to the handle of the door—into the "suspicion state". A security officer receives a "suspicion signal".

Figure 36:
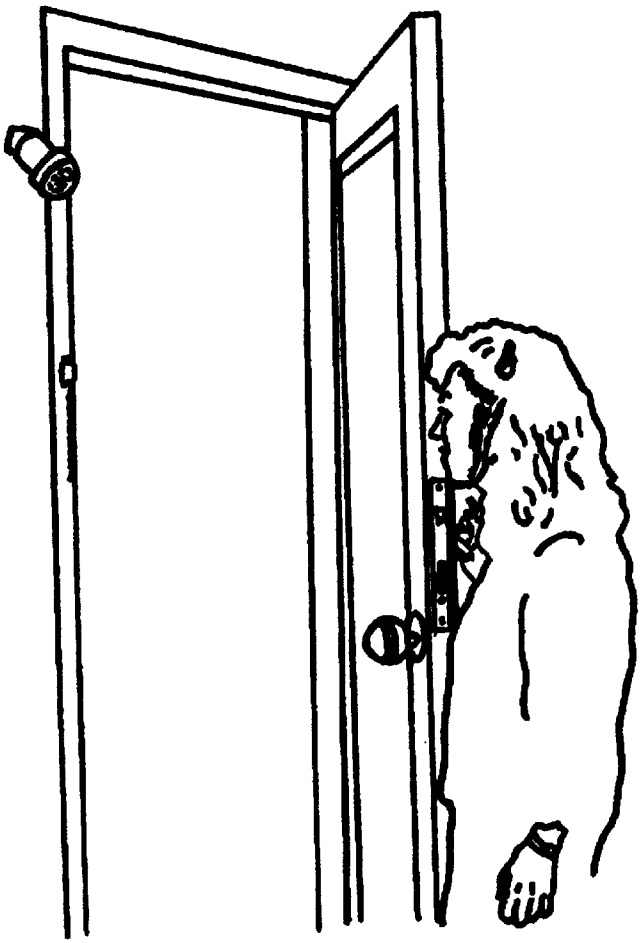

FIG. 36: The user keeps pressing the device's handle while opening the door, to maintain the "suspicion signal".

Figure 37:
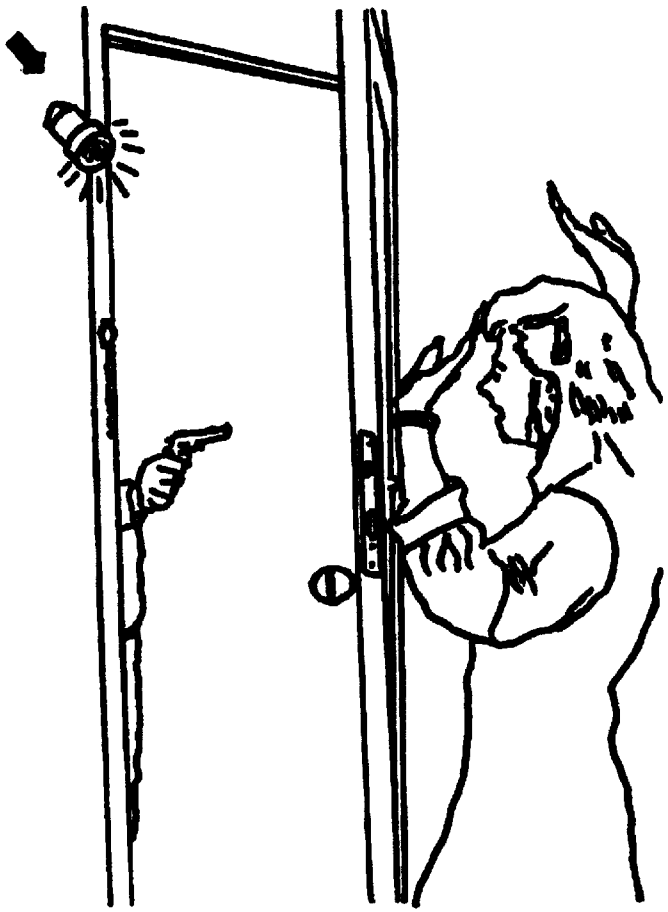

FIG. 37: The stranger attacks the user by a gun. As a normal reaction, the user leaves the door's handle and raises her hands up. The device is thus automatically brought to the "reaction warning state". On closing the "warning circuit", a "warning signal" is transmitted to a security office and a siren is operated as shown in the figure.

Figure 39:
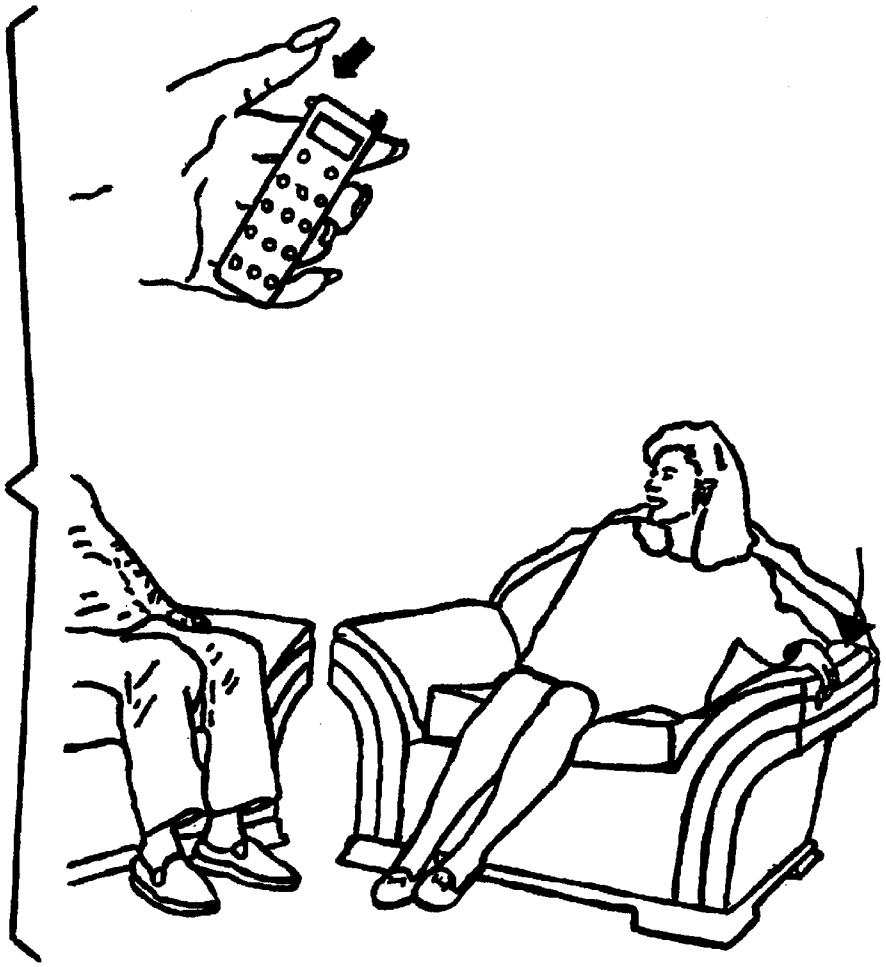
FIGS. 38,39 & 40 illustrate the sequence of events, on using the device when a visitor attacks someone.
Figure 38:
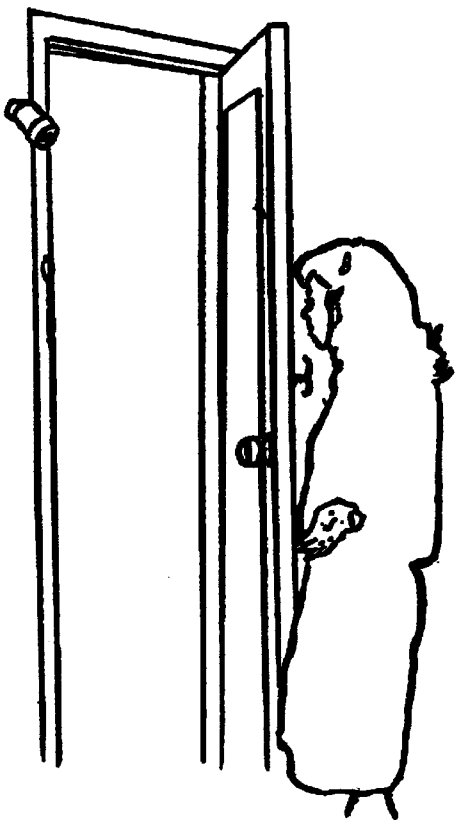
Figure 40:
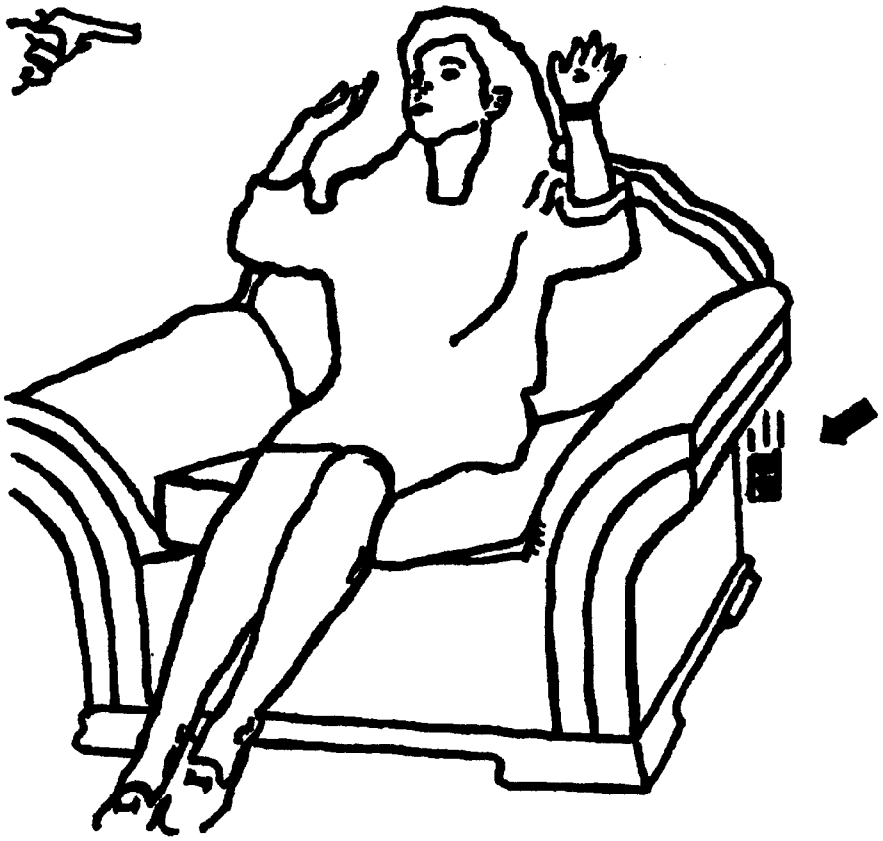

FIGS. 38, 39 and 40 illustrate the sequence of events on using the device when someone is attacked by a visitor. The scenario is as follows:

FIG. 38: The user opens the door and invites someone to come in.

FIG. 39: The device's user feels suspicious about the visitor; so she adjusts the handle to the "suspicion state". The device is either wirely connected and fixed to the arm of the chair; or wirelessly connected and fixed to a mobile telephone or a radio set. The later can be of a very small size and take the shape of a common item like a finger ring, a bracelet or a brooch. An amplifier has to be used to amplify the signal transmitted by such small item. The amplifier can be fixed at any suitable location.

FIG. 40: The visitor attacks the user by a gun; so she raises her hands as a normal reaction. The device is thus automatically brought to the "reaction warning state". On closing the "warning circuit", a "warning signal" is transmitted to a security office and a siren is operated.

Figure 42:
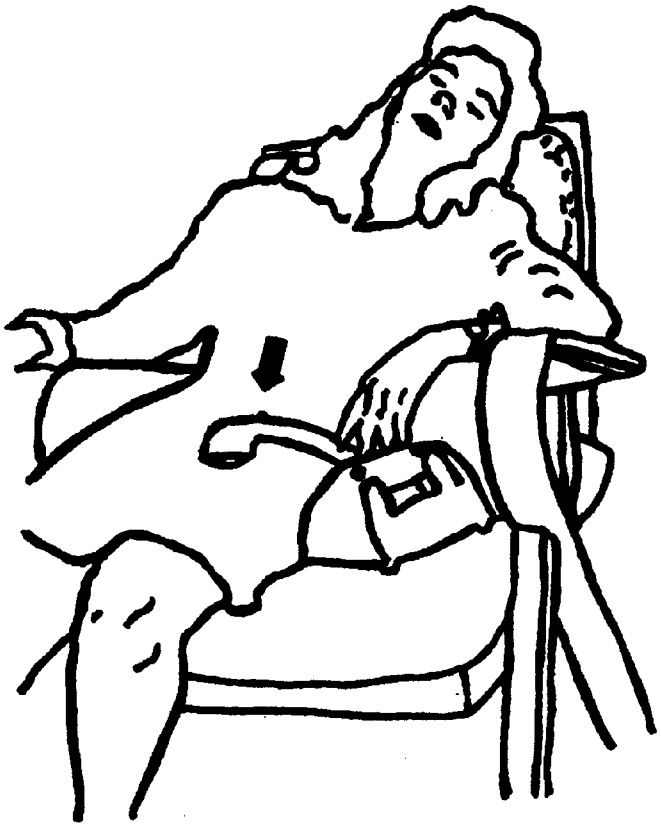
FIGS. 41 & 42 illustrate the sequence of events, when a patient goes into a coma after using the device.
Figure 41:
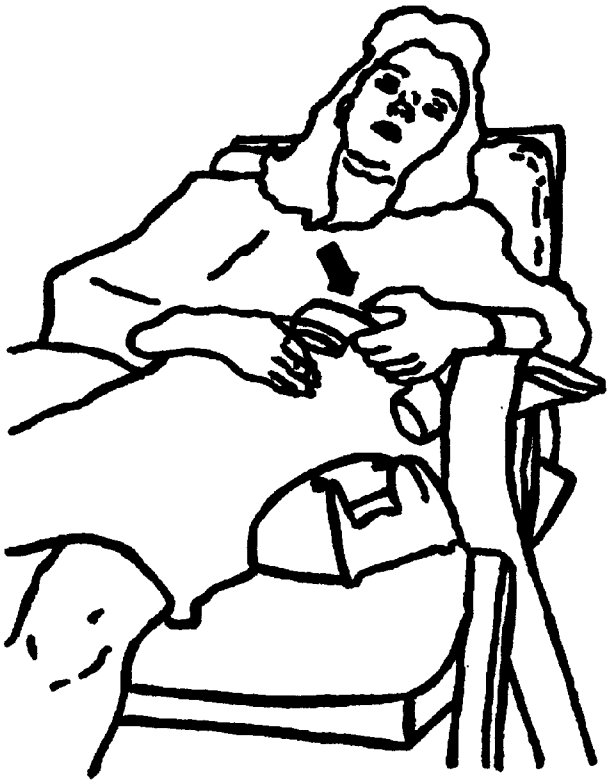

FIGS. 41 and 42 illustrate the sequence of events when a patient goes into a coma after using the device. The scenario is as follows:

FIG. 41: The patient—feeling that she may lose consciousness—adjusts the device, fixed to the handset of a telephone, to the "suspicion state".

FIG. 42: The patient goes into a coma; and so the handset drops. The device is thus automatically brought to the "reaction warning state".

In the various applications of the device, the following should be noted:

1. Using the device when fixed to a wireless set as shown in FIG. 32: This can be used by guards, so their security offices get signals in case they are attacked, injured or killed. People who work in dangerous places may also use a device fixed to their radio sets, so they may get help on facing troubles.
2. Using a wirelessly connected device in general as shown in FIGS. 31, 32 and 33: In these application, the transmission of warning signals only, to a security office, may become useless without determining the user's location. The following may be helpful:
   A. Informing the security office of the places, the user regularly goes to.
   B. Informing the security office of the place before or after transmitting a "suspicion signal". The user may do that by calling the security office or by pressing a code number.
   C. Using a special set that determines the user's location.
3. Using the device by patients who suffer from spasmodic contraction as shown in FIG. 41:

If the patient—in this case—goes into a coma, he/she will not drop the handset of the telephone off his/her hand. In this case the "suspicion signal" transmitted already will be maintained. Such cases should be reported formerly to the treating doctor's clinic, an ambulance or a security office so they can act promptly on receiving a relatively long suspicion signal.

I claim:

1. A four-states warning switch, comprising:

a. a hollow housing, said housing electrically connected to a first electric circuit and a separate, second electric circuit;

b. a hollow actuating cylinder element enclosed inside said housing and pivoted to said housing by a pivot pin from one end, said actuating cylinder element enclosing:

i. a piston having two parts, an inside part and an extension of a smaller diameter extending outside said actuating cylinder element, movable only leftwards, guided by a groove in the inner surface of said housing, ii. an activated only when pressed first push-button switch, electrically connected to said first electric circuit, iii. a rod, fixed to said inside part of said piston, with tip of said rod facing said first push-button switch so as to press said first push-button switch when said piston moves inwards, iv. a bar fixed to said piston extension, and extending outside said housing, guided by a slot in said housing for rightward and leftward movement with said slot having same center line of said groove, v. a compression spring, fitted between said inside part of said piston and said first push-button switch, c. a protrusion on outer surface of said actuating cylinder element, d. a handle fixed to said bar, e. an activated only when pressed second push-button switch, electrically connected to said second electric circuit, fixed to inner surface of said housing , having a side "U" shape opening wherein said bar fits smoothly on reaching the right end of said slot on pressing said handle and shifting said actuating cylinder element rightwards so as to activate said second push-button switch by said piston extension, f. an activated only when pressed third push-button switch, electrically connected to said second electric circuit and connected in parallel to said second push-button switch, fixed to inner surface of said housing thereat a spot facing said protrusion of said actuating cylinder element so as to activate it by shifting said actuating cylinder element leftwards until said protrusion presses said third push-button switch.

2. A four-states warning switch of claim 1, wherein said piston having such form and dimensions so that its said inside part remains always inside the said actuating cylinder element; and said piston extension remains totally or partially outside said actuating cylinder element even when said piston is pressed inwards.

3. A four-states warning switch of claim 1, wherein said groove and said slot having such a form so that said actuating cylinder element can not be moved rightwards except when said handle is pressed.

4. A four-states warning switch of claim 1, wherein said handle having five settings whereby:

in first setting, said four-states warning switch is in its off state, said handle is not pressed, said piston extension is inside said groove positioned at the right end of said groove;

in second setting, said handle is pressed to activate said first push-button switch;

in third setting, said handle is moved rightwards while being pressed until said bar reaches right end of said slot;

in fourth setting, said handle is released to inactivate said first push-button switch and activate said second push-button switch;

in fifth setting, said handle is moved leftwards to activate said third push-button switch.

5. A four-states warning switch of claim 4, wherein said slot in said housing having circular openings at two spots; whereby said first setting and said second setting of said handle taking place at the first spot, while said third setting and said fourth setting of said handle taking place at the second spot; and said bar having larger clearance at said two spots than the clearance between said bar and the rest of said slot, allowing the user to feel where to locate said handle without looking.

6. A four-states warning switch of claim 1, further comprising:

additional push-button switches fitted beside said second push-button switch; allowing for extra warning functions or signals when required, said additional push-button switches are of a split type, so that said bar passes through them to the required position; and fixed to inner surface of said housing, facing said piston extension when said actuating cylinder element is shifted rightwards.

7. A four-states warning switch of claim 1, further comprising:

a second compression spring, fitted between the left side of said actuating cylinder element and said housing so as to facilitate the movement of said actuating cylinder element rightwards when extra power is required.

8. A four-states warning switch of claim 1, wherein said pivot connection of said actuating cylinder element to said housing is replaced by slide attachments on both ends of said actuating cylinder element so as to effect slide movement inside said housing when straight movement of said handle is required.

9. A four-states warning switch of claim 5, further comprising:

an angle shape of said slot whereby:

i. said first spot on the position where said first setting and said second setting of said handle take place is located at the vertex of said angle, ii. said bar does not move leftwards from said first spot, but deviates, making an angle before it activates said third push-button switch to prevent unintentional shifting of said handle leftwards when required; and iii. said pivot connection of said actuating cylinder element to said housing is modified to allow for angle movement.

10. A four-states warning switch of claim 1, wherein said third push-button switch fixed to the outside surface of said housing when clearer location is required, so that the pressing of said third push-button switch is effected directly by the user; and so limiting the movement of said actuating cylinder element to the right direction.

11. A four-states warning switch of claim 1, wherein the size of said four-states warning switch is minimized when required, by replacing said first push-button switch, said second push-button switch and said third push-button switch by three pairs of terminal lugs whereby said rod, said piston extension and said protrusion are electrically insulated and they contact said pairs of terminal lugs directly.

12. A four-states warning switch of claim 11, wherein the outer body of said actuating cylinder element is eliminated when minimized size is required, whereby the electric connection between first pair of said terminal lugs replacing said first push-button switch effected by a flange fitted before the end of said rod allowing the tip of said rod to fit in a hole between said first pair of terminal lugs when said handle is pressed inward, and the electric connection between third pair of said terminal lugs replacing said third push-button switch effected by a line shaped protrusion, fixed to the side of said piston and facing said third pair of terminal lugs.

13. A four-states warning switch in form of a hollow actuating cylinder element, electrically connected to a first electric circuit and to a separate second electric circuit, comprising:

a. a horizontally drawn "T" shaped slot in the body of said actuating cylinder element, wherein the horizontal side ends with a circular opening and the lower vertical side is wider than the upper vertical side; and b. said actuating cylinder element enclosing:

i. an activated only when pressed upper push-button switch fixed to the upper end inside the cylinder hollow of said actuating cylinder element and electrically connected to said first electric circuit, ii. an activated only when pressed lower push-button switch fixed to the lower end of said cylinder hollow and electrically connected to said second electric circuit, iii. a piston located between said upper push-button switch and said lower push-button switch, with its lower end facing said lower push-button switch so as to press and activate it when said piston moves downwards, iv. a rod fixed to upper side of said piston, with its tip facing said upper push-button switch so as to press and activate it when said piston moves upwards, v. a bar fixed to the cylindrical surface of said piston, extending outside the body of said actuating cylinder element through said slot, vi. a handle fixed to said bar, and used in shifting said piston upwards or downwards through said bar guided by said slot, vii. a compression spring fitted between said piston and said upper push-button switch, pressing said piston downwards.

14. A four-states warning switch of claim 13, wherein said handle having four settings, whereby:

in first setting, said four-states warning switch is in its off state, said bar is positioned in said horizontal side of said slot;

in second setting, said handle is shifted upwards until said bar reaches its final position in said upper side of said slot so that said upper push-button switch is activated;

in third setting, said handle is released so that said bar moves vertically downwards along said upper side and said lower side of said slot, reaching its final position, so that said lower push-button switch is activated, and said upper push-button switch is inactivated; and in fourth setting, said handle is shifted downwards until said bar reaches its final position in said lower side of said slot, so that said lower push-button switch is activated.

15. A four-states warning switch of claim 13, wherein the lower side of said slot having such a form so as to facilitate the moving of said bar from the upper side to said lower side of said slot.

16. A four-states warning switch of claim 13, wherein the horizontal side of said slot having such a form so as to avoid an unintentional slipping of said bar from its position.

17. A four-states warning switch of claim 13, wherein the size of said four-states warning switch is minimized when required, by replacing said upper push-button switch and said lower push-button switch by two pairs of terminal lugs, whereby said piston and said rod are electrically insulated and they contact said pairs of terminal lugs directly.

* * * * *